US011024471B2

(12) United States Patent
Doro et al.

(10) Patent No.: US 11,024,471 B2
(45) Date of Patent: Jun. 1, 2021

(54) PUSH SWITCH

(71) Applicant: Panasonic Intellectual Property Management Co., Ltd., Osaka (JP)

(72) Inventors: Kunio Doro, Okayama (JP); Hirokazu Kobayashi, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/640,578

(22) PCT Filed: Aug. 27, 2018

(86) PCT No.: PCT/JP2018/031470
§ 371 (c)(1),
(2) Date: Feb. 20, 2020

(87) PCT Pub. No.: WO2019/044725
PCT Pub. Date: Mar. 7, 2019

(65) Prior Publication Data

US 2020/0194192 A1 Jun. 18, 2020

(30) Foreign Application Priority Data

Sep. 1, 2017 (JP) ..... JP2017-169015
Jan. 23, 2018 (JP) ..... JP2018-009208

(51) Int. Cl.
*H01H 1/06* (2006.01)
*H01H 13/10* (2006.01)
(Continued)

(52) U.S. Cl.
CPC ..... *H01H 1/06* (2013.01); *H01H 13/10* (2013.01); *H01H 13/14* (2013.01); *H01H 13/52* (2013.01)

(58) Field of Classification Search
CPC ..... H01H 1/06; H01H 13/10; H01H 13/14; H01H 11/00; H01H 49/00
(Continued)

(56) References Cited

U.S. PATENT DOCUMENTS 2,854,074 A * 9/1958 Frank ..... B21D 39/03 29/566
2008/0035462 A1* 2/2008 Yanai ..... H01H 13/48 200/406
2011/0089004 A1* 4/2011 Yanai ..... H01H 13/06 200/275

FOREIGN PATENT DOCUMENTS

JP 54-086763 7/1979
JP 3-082525 U 8/1991
(Continued)

OTHER PUBLICATIONS

International Search Report of PCT application No. PCT/JP2018/031470 dated Sep. 25, 2018.

*Primary Examiner* — Edwin A. Leon
*Assistant Examiner* — Iman Malakooti
(74) *Attorney, Agent, or Firm* — McDermott Will and Emery LLP

(57) ABSTRACT

A push switch includes a stationary contact and a movable contact. The stationary contact includes a base material and a conductive layer that covers the base material. The movable contact is disposed opposite a contact surface of the stationary contact. The movable contact is movable between a first position where the movable contact is in contact with the contact surface and a second position where the movable contact is apart from the contact surface. The stationary contact has a groove that divides the contact surface into a plurality of areas. Connection surfaces connect respective opening edges of the groove with a bottom of the groove.
(Continued)

Each of the connection surfaces has a slope that is inclined at acute angle relative to the contact surface.

18 Claims, 18 Drawing Sheets

(51) Int. Cl.
*H01H 13/14* (2006.01)
*H01H 13/52* (2006.01)

(58) Field of Classification Search
USPC ..... 200/5 A, 238, 240, 279
See application file for complete search history.

(56) References Cited

FOREIGN PATENT DOCUMENTS

| | | |
|---|---|---|
| JP | 2008-041603 | 2/2008 |
| JP | 2012-022970 | 2/2012 |
| JP | 2016-115612 | 6/2016 |

* cited by examiner

PUSH SWITCH

CROSS-REFERENCE TO RELATED APPLICATIONS

This application is a U.S. national stage application of the PCT International Application No. PCT/JP2018/031470 filed on Aug. 27, 2018, which claims the benefit of foreign priority of Japanese patent application No. 2017-169015 filed on Sep. 1, 2017 and Japanese patent application No. 2018-009208 filed on Jan. 23, 2018, the contents all of which are incorporated herein by reference

TECHNICAL FIELD

The present disclosure generally relates to push switches. The present disclosure specifically relates to a push switch closed or opened by deformation of a movable component.

BACKGROUND ART

Some known push switches each include a case that includes switch contacts, and a protective sheet that covers the case (see PTL 1, for example).

A push switch disclosed in PTL 1 includes a case (switch case) that has a depression that opens upward. A bottom surface (inner bottom surface) of the depression of the case includes a stationary contact (central stationary contact). Further, a movable component (a second movable contact) is disposed in the depression. The movable component is an elastic metal sheet that is curved like a dome that protrudes upward. The movable component is substantially circular. A protective sheet is disposed on the case to cover the depression.

When the push switch is operated, force is applied to a top surface of the protective sheet. The force is transferred to the movable component. Consequently, the movable component deforms (elastic reversal). Consequently, an underside of the movable component comes into contact with the stationary contact. Consequently, the push switch is closed. If the force ceases to be applied to the protective sheet, the movable component deforms into an original shape (a shape like a dome that protrudes upward) (elastic restoration). Consequently, the push switch is opened.

CITATION LIST

Patent Literature

PTL 1: Unexamined Japanese Patent Publication No. 2008-41603

SUMMARY OF THE INVENTION

A push switch according to an aspect of the present disclosure includes a stationary contact and a movable contact. The stationary contact includes a base material and a conductive layer that covers the base material. The movable contact is disposed opposite a contact surface of the stationary contact. The movable contact is movable between a first position where the movable contact is in contact with the contact surface and a second position where the movable contact is apart from the contact surface. The stationary contact has a groove that divides the contact surface into a plurality of areas. Connection surfaces connect respective opening edges of the groove with a bottom of the groove.

Each of the connection surfaces has a slope that is inclined at an acute angle relative to the contact surface.

The present disclosure has an advantage that electrical properties are less likely to vary.

BRIEF DESCRIPTION OF THE DRAWINGS

In FIG. 3A, a protective sheet, a pressing component, and a movable component are removed from the push switch.

In FIG. 4A, the protective sheet is removed from the push switch.

In FIG. 5A, the push switch is not operated.

In FIG. 5B, the push switch is operated.

In FIG. 16, the protective sheet is removed from the push switch.

In FIG. 19A, a protective sheet is removed from the push switch.

In FIG. 19B, a protective sheet is removed from the push switch.

DESCRIPTION OF EMBODIMENT

Figure 1:
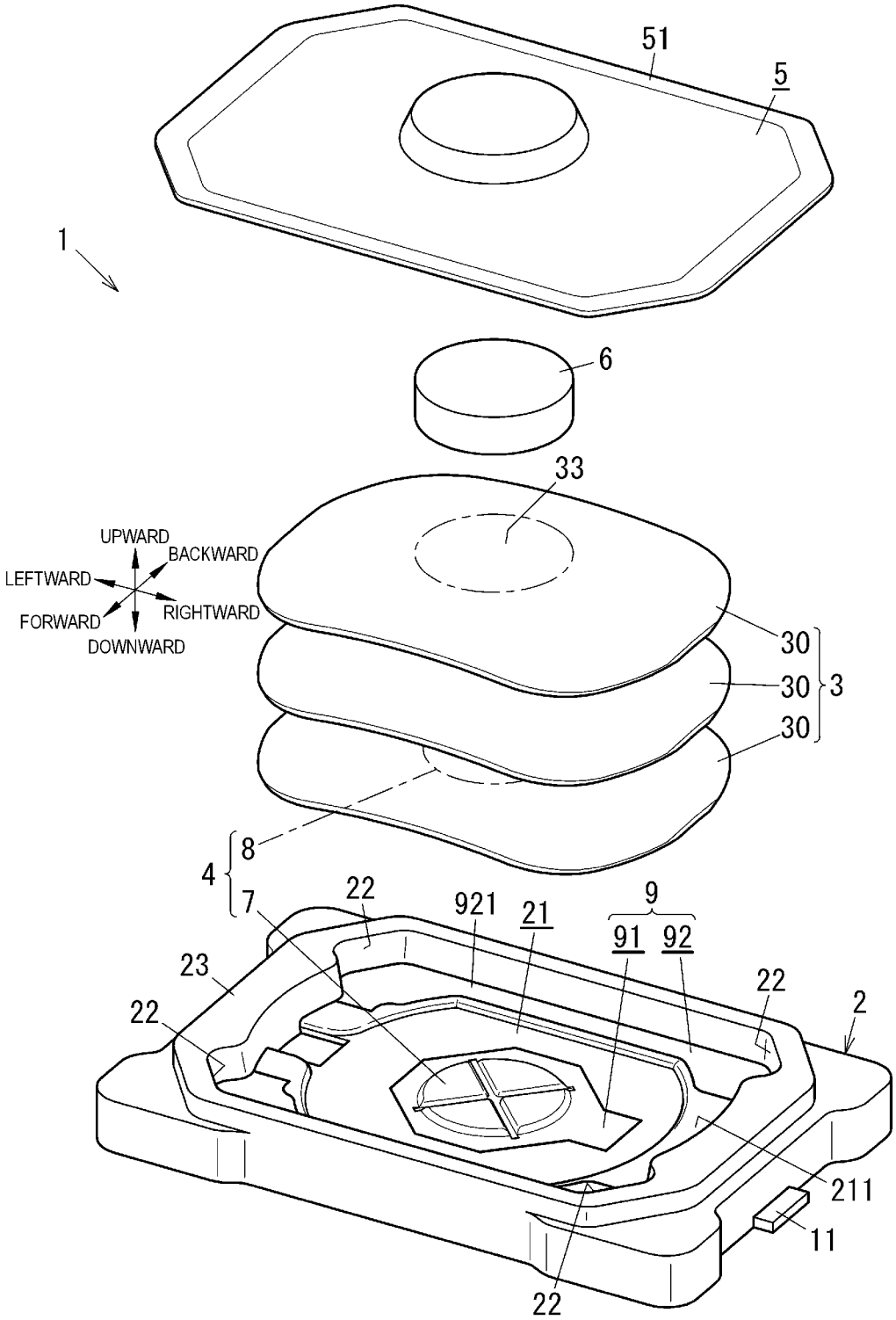
FIG. 1 is an exploded perspective view of a push switch according to an exemplary embodiment of the present disclosure.
Figure 2A:
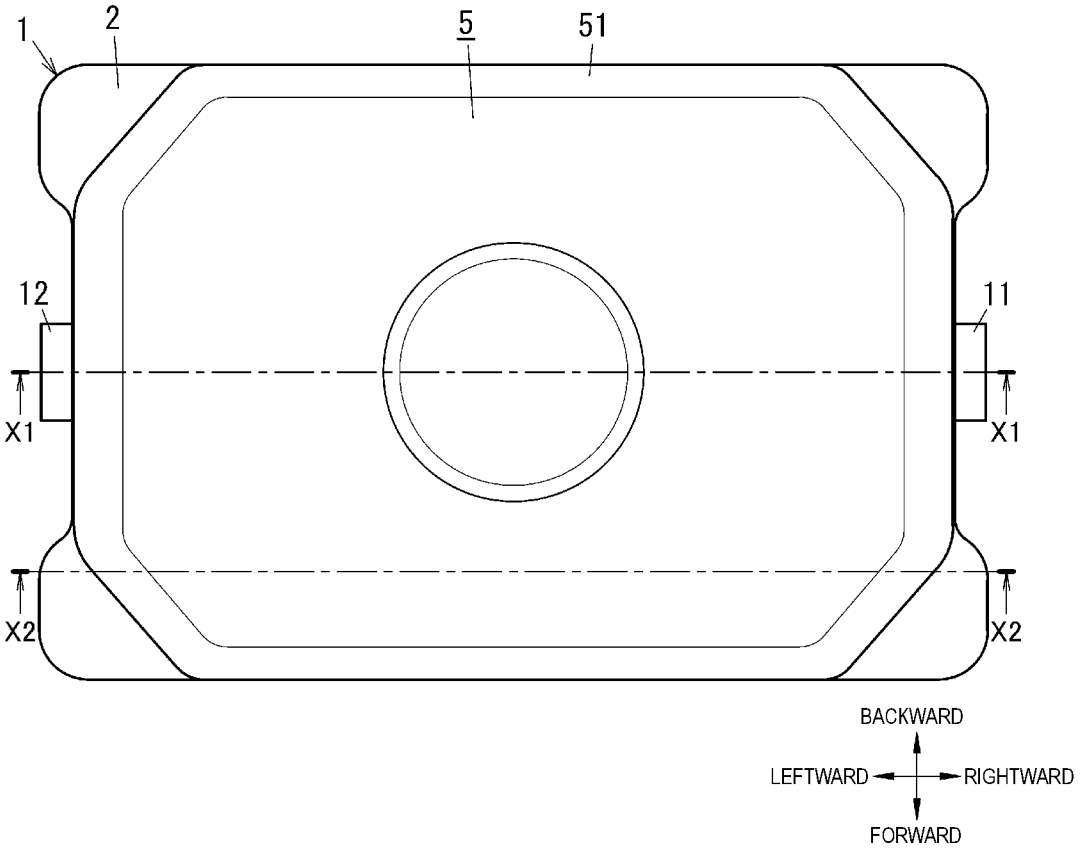
FIG. 2A is a plan view of the push switch according to the exemplary embodiment of the present disclosure.
Figure 2B:
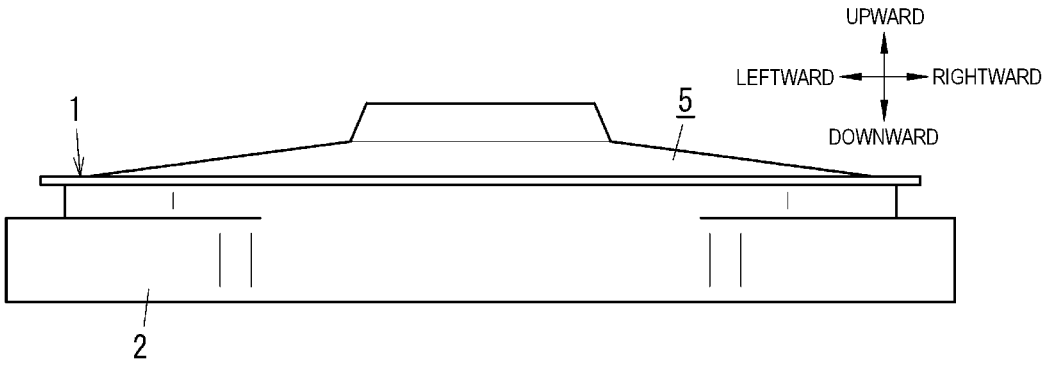
FIG. 2B is an elevation view of the push switch according to the exemplary embodiment of the present disclosure.

In such a push switch as described above, when the push switch is operated, an underside of a central portion of a movable contact comes into contact with a top surface of a stationary contact. Consequently, the movable contact electrically connects with the stationary contact. However, the top surface of the stationary contact (a contact surface with which the movable contact is in contact) is one flat plane. Therefore, for example, if foreign matter enters between the stationary contact and the movable contact, electrical properties of the push switch may deteriorate.

The present disclosure allows electrical properties to be less likely to vary.

Exemplary Embodiment (1) Outline

As illustrated in FIGS. 1 to 4B, push switch 1 according to a present exemplary embodiment includes case 2, movable component 3, and contacts 4.

Case 2 has depression 21. Movable component 3 has pressure receiving portion 33, and is disposed in depression 21. When pressure receiving portion 33 is pushed toward bottom surface 211 of depression 21, movable component 3 deforms. Consequently, contacts 4 are closed or opened. Contacts 4 include (first) stationary contact 7 and movable contact 8. Stationary contact 7 is fixed to case 2. Movable component 3 has movable contact 8 that is disposed opposite contact surface 73 of stationary contact 7. Deformation of movable component 3 moves movable contact 8 between a closed position (first position) where movable contact 8 is in contact with contact surface 73 and an open position (second position) where movable contact 8 is apart from contact surface 73. That is to say, contacts 4 are closed while movable contact 8 is at the closed position (first position). Alternatively, contacts 4 are open while movable contact 8 is at the open position (second position).

In such push switch 1, movable component 3 deforms and may rub against bottom surface 211 of depression 21 of case 2. If excessive force is applied to movable component 3, powder P1 may be scraped from case 2 (see FIG. 3B). Although details will be described later, in the present exemplary embodiment, contact portions 212 of bottom surface 211 of depression 21 expose one of metal components 9. Movable component 3 is in contact with contact portions 212. Therefore, movable component 3 rubs against the one of metal components 9 at contact portions 212. Therefore, powder P1 may be scraped from the one of metal components 9. Scraped powder P1 that has been generated as described above may accumulate at contact portions 212 with which movable component 3 is in contact. Contact portions 212 are portions of bottom surface 211 of depression 21 of case 2. If scraped powder P1 accumulates at contact portions 212, tactility and electrical properties of push switch 1 may vary.

Figure 7A:
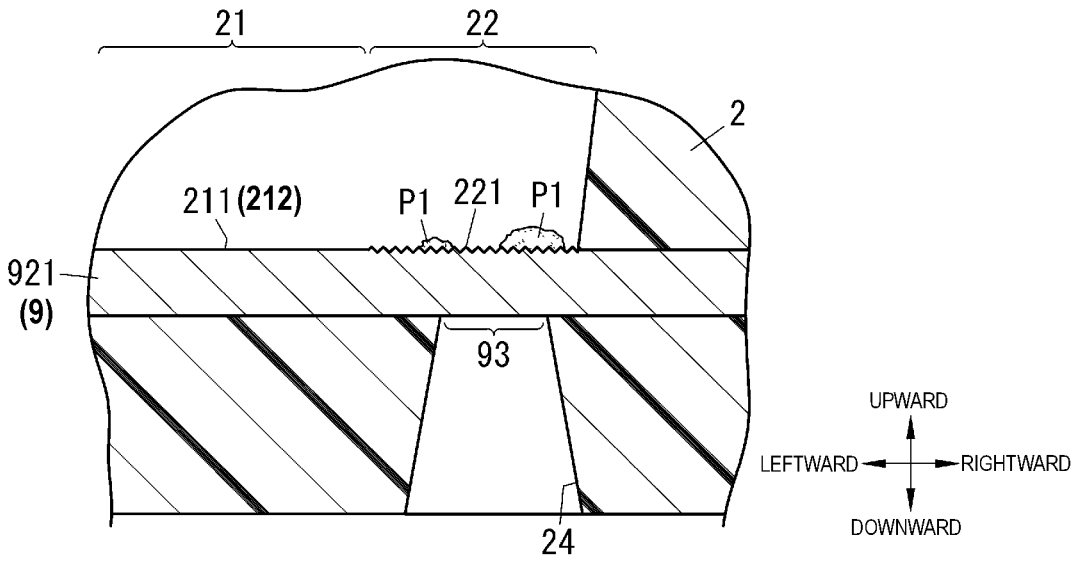
FIG. 7A is a schematic cross-sectional view of an aspect of one of enlarging depressions of the push switch according to the exemplary embodiment of the present disclosure.
Figure 7B:
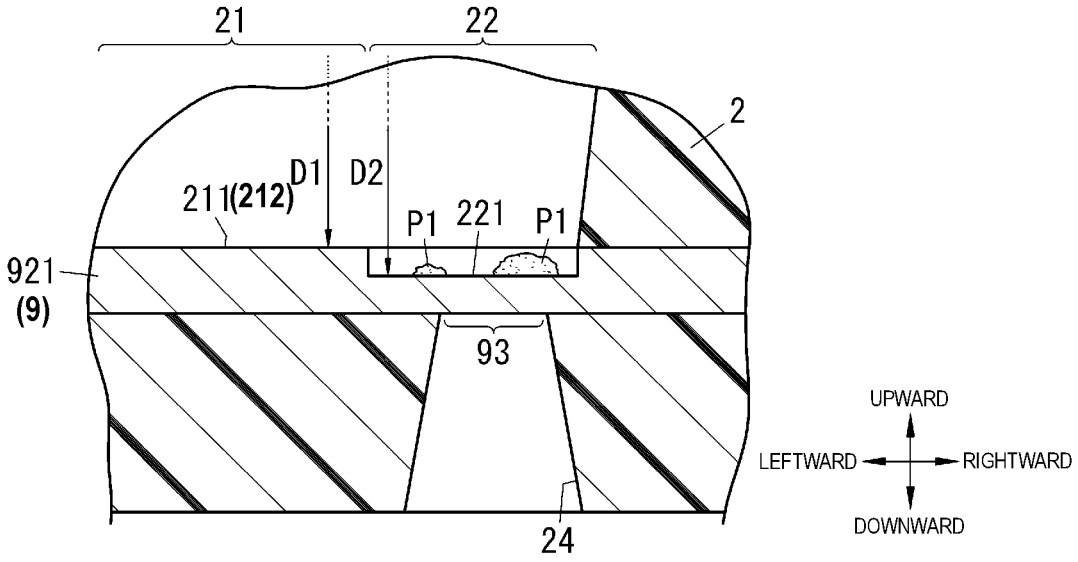
FIG. 7B is a schematic cross-sectional view of an aspect of one of enlarging depressions of the push switch according to the exemplary embodiment of the present disclosure.

In the present disclosure, bottom surface 211 of depression 21 of case 2 exposes metal component 92. Part of metal component 92 functions as stationary contact 921. In the following description, metal component 92 that is exposed forms part of the bottom surface of depression 21. In the description of the present disclosure, a top surface of stationary contact 921 (metal component 92) exposed by bottom surface 211 of depression 21 of case 2 is part of bottom surface 211 of depression 21 of case 2, as illustrated in FIGS. 7A and 7B, for example. Similarly, in the description, part of a top surface of metal component 92 exposed by bottom surfaces 221 of enlarging depressions 22 is part of bottom surfaces 221 of enlarging depressions 22 of case 2. Details of FIGS. 7A and 7B will be described later.

Figure 3A:
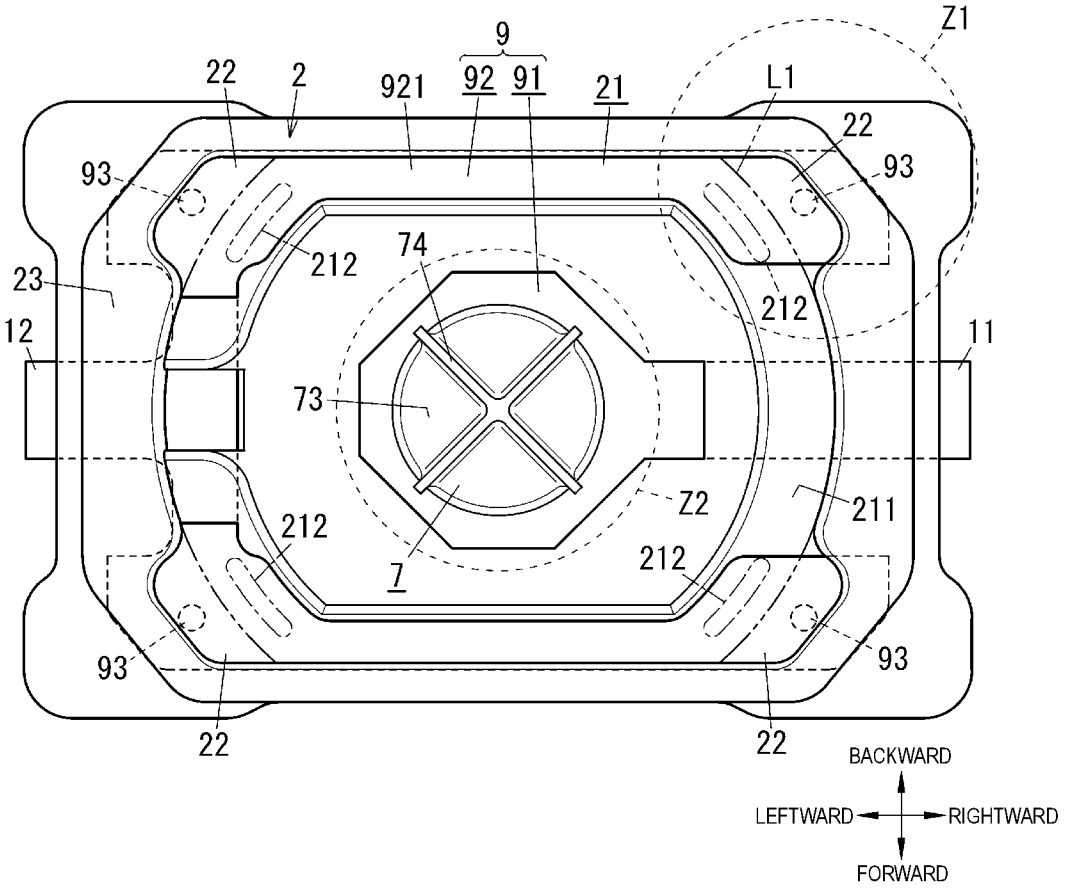
FIG. 3A is a plan view of the push switch according to the exemplary embodiment of the present disclosure.
Figure 3B:
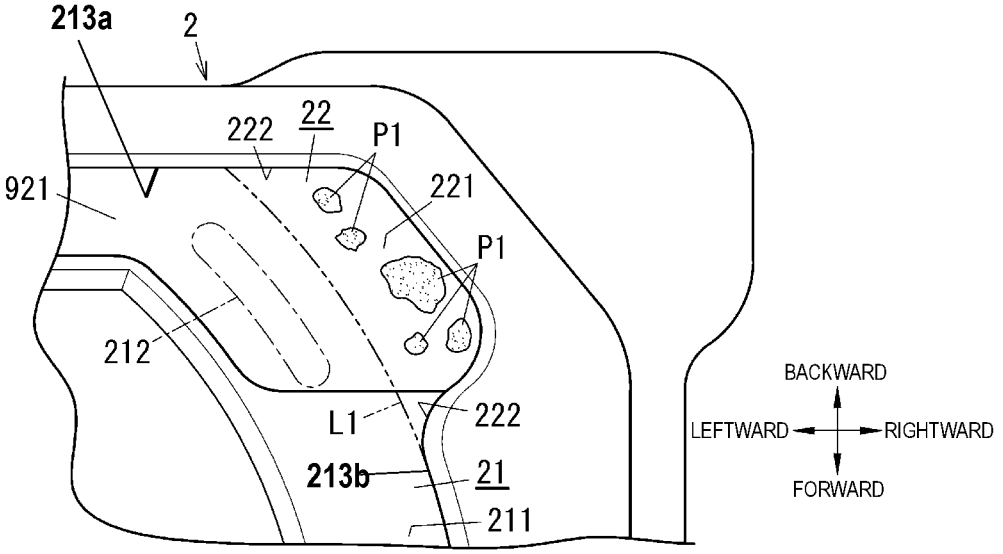
FIG. 3B is an enlarged view of area Z1 in FIG. 3A.

As a countermeasure against scraped powder P1 described above, push switch 1 according to the present exemplary embodiment includes enlarging depressions 22 in case 2, as illustrated in FIGS. 3A and 3B. Enlarging depressions 22 are adjacent to depression 21. That is to say, case 2 also has enlarging depressions 22. Enlarging depressions 22 are adjacent to respective contact portions 212 of bottom surface 211 of depression 21. Movable component 3 is in contact with contact portions 212. Further, depression 21 and enlarging depressions 22 are integrally made. That is to say, a depression of case 2 is depression 21 enlarged by enlarging depressions 22. In the present disclosure, the expression "are adjacent to" means that "are adjacent to and connect with". That is to say, the expression "are adjacent to" means that "are adjacent to each other". Further, in the present disclosure, the expression "enlarging" means that "enlarging an extent". That is to say, in the present exemplary embodiment, case 2 has enlarging depressions 22. Each of enlarging depressions 22 extends outward relative to corresponding one of contact portions 212. Movable component 3 is in contact with contact portions 212. Contact portions 212 are portions of bottom surface 211 of depression 21. Therefore, if powder P1 is scraped from case 2 or the one of metal components 9 at contact portions 212, scraped powder P1 moves into enlarging depressions 22 from contact portions 212 in depression 21. Therefore, in push switch 1, scraped powder P1 is less likely to accumulate at contact portions 212 with which movable component 3 is in contact. Contact portions 212 are portions of bottom surface 211 of depression 21 of case 2. Therefore, push switch 1 has an advantage that scraped powder P1 is less likely to vary tactility and electrical properties of push switch 1.

Figure 9:
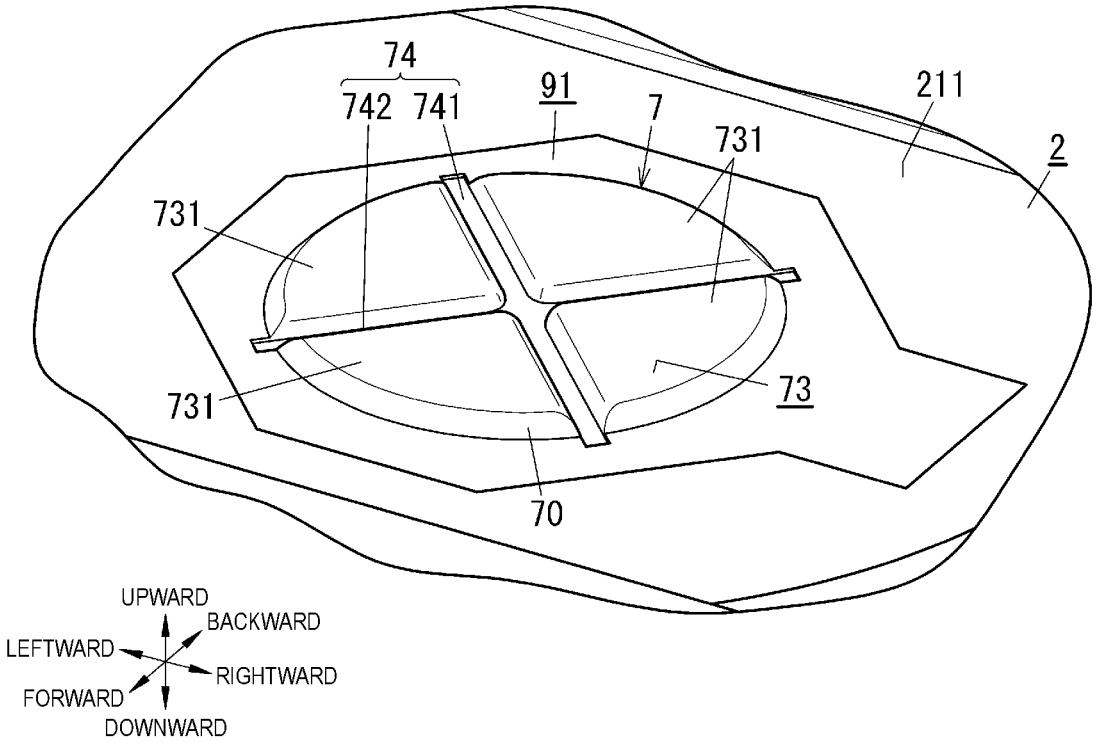
FIG. 9 is a perspective view of an important part that illustrates a stationary contact of the push switch according to the exemplary embodiment of the present disclosure.

In push switch 1 according to the present exemplary embodiment, stationary contact 7 has contact surface 73 that is opposite movable contact 8, and grooves 74 that divide contact surface 73 into a plurality of areas 731, as illustrated in FIG. 9. Since grooves 74 divide contact surface 73 into the plurality of areas 731, a structure-for-contact-at-a-plurality-of-positions is made for contacts 4. The structure-for-contact-at-a-plurality-of-positions allows movable contact 8 to be in contact with a plurality of positions of stationary contact 7. Therefore, for example, even if foreign matter enters between stationary contact 7 and movable contact 8, electrical properties of push switch 1 are less likely to deteriorate, compared with a case in which contact surface 73 of stationary contact 7 is one flat plane.

Figure 10A:
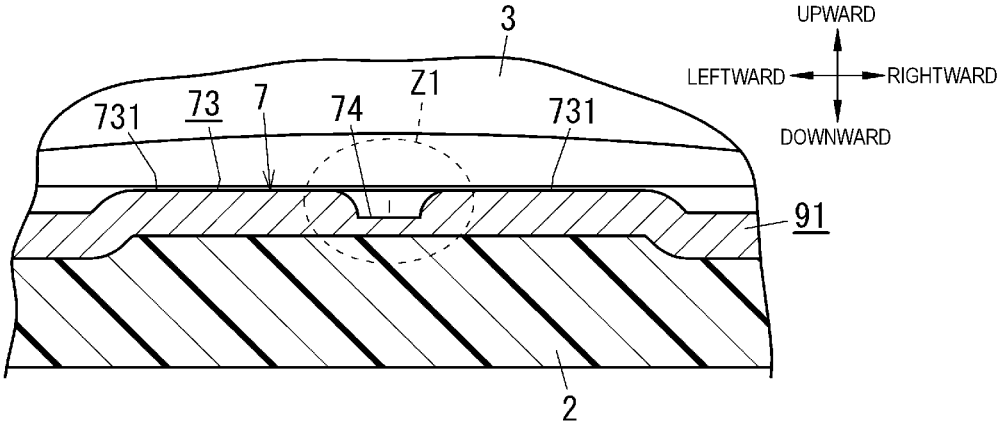
FIG. 10A is an enlarged view of area Z1 in FIG. 5A.
Figure 10B:
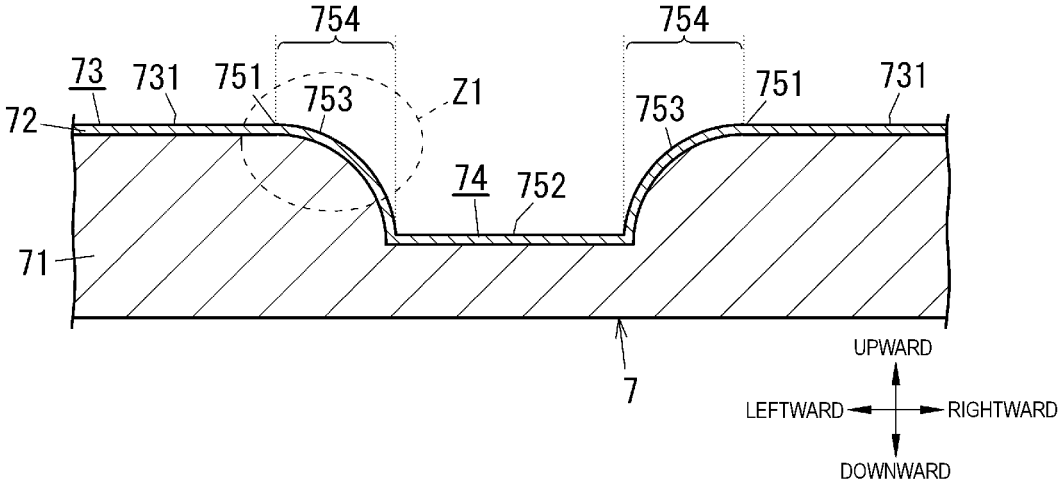
FIG. 10B is an enlarged schematic view of area Z1 in FIG. 10A.

In case of push switch 1 that has the structure-for-contact-at-a-plurality-of-positions, however, if excessive force is applied to movable component 3, part of conductive layer 72 of stationary contact 7 (see FIG. 10B) is likely to be removed from base material 71 of stationary contact 7 (see FIG. 10B). If part of conductive layer 72 is removed, electrical properties of push switch 1 may vary.

Figure 10C:
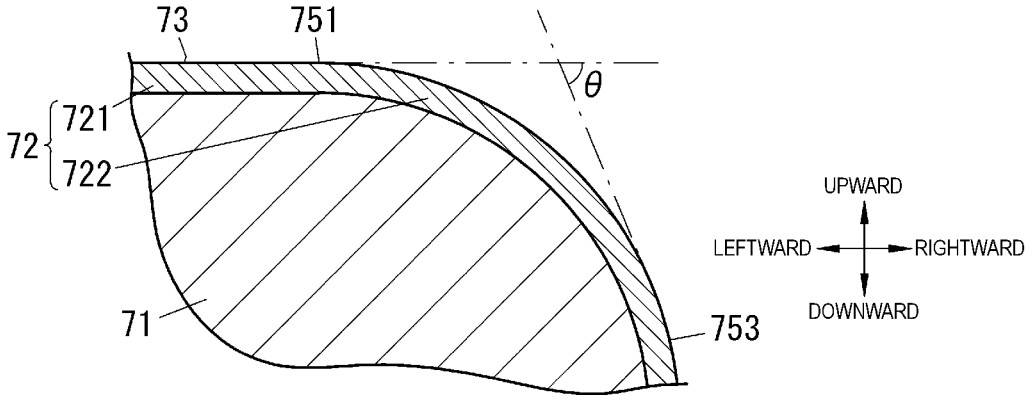
FIG. 10C is an enlarged schematic view of area Z1 in FIG. 10B.

In push switch 1 according to the present exemplary embodiment, each of grooves 74 has connection surfaces 753 that connect respective opening edges 751 of each of grooves 74 with bottom 752 of each of grooves 74, as illustrated in FIGS. 10A to 10C. Each of connection surfaces 753 has slope 754, as a countermeasure against the removal of conductive layer 72 described above. Each of slopes 754 is inclined at acute angles θ relative to contact surface 73 (see FIG. 10C). The configuration allows conductive layer 72 to be less likely to be damaged at opening edges 751 of grooves 74. Further, the configuration allows a stress concentration to be less likely to occur at opening edges 751 of grooves 74 when movable contact 8 is pushed against stationary contact 7. Therefore, push switch 1 has an advantage that conductive layer 72 is less likely to be removed, and thus electrical properties of push switch 1 are less likely to vary though push switch 1 has the structure-for-contact-at-a-plurality-of-positions.

(2) Details

Push switch 1 that will be described later is applied to controls of various devices, such as personal digital assistants, devices in a vehicle, and home appliances. For example, push switch 1 is attached to a printed circuit board in a housing of such a device. In that case, the housing includes an operational button, for example, at a position that corresponds to push switch 1. Consequently, a user indirectly operates push switch 1 through the operational button by pressing down the operational button.

Hereinafter, a top surface of case 2 is a surface of case 2 where depression 21 is made, unless otherwise specified. Further, an "upward direction" and a "downward direction" are along a depth of depression 21, unless otherwise specified. Further, a "rightward direction" is a direction in which first terminal 11 that will be described later protrudes from case 2. A "leftward direction" is a direction in which second terminal 12 that will be described later protrudes from case 2. A forward direction and a backward direction (directions that are perpendicular to a paper surface of FIG. 2B) are perpendicular to all the upward direction, the downward direction, the rightward direction, and the leftward direction. That is to say, the upward direction, the downward direction, the leftward direction, the rightward direction, the forward direction, and the backward direction are defined as represented by an arrow that points "upward", an arrow that points "downward", an arrow that points "leftward", an arrow that points "rightward", an arrow that points "forward", and an arrow that points "backward", respectively, in FIG. 1, for example. However, the directions do not limit a direction in which push switch 1 is used. Further, the arrows that point the respective directions are illustrated only for explanation in the drawings. The arrows are unsubstantial.

(2.1) Basic Configuration

As illustrated in FIGS. 1 to 4B, push switch 1 according to the present exemplary embodiment also includes protective sheet 5, pressing component 6, and metal components 9, in addition to case 2, movable component 3, and contacts 4. In the following description, push switch 1 is not operated. That is to say, push switch 1 is not pushed, unless otherwise specified.

Case 2 is made of a synthetic resin that possesses electrical insulation. Case 2 has a shape like a cuboid. Case 2 has a thin thickness and has a flat top surface and a flat underside. Top surface 23 of case 2 is a surface in a thickness direction of case 2. Top surface 23 has depression 21. Depression 21 opens upward (in a first direction). In the present exemplary embodiment, depression 21 has a shape like an ellipse whose lateral length is longer than a vertical length of the ellipse, in a top view. A center of depression 21 corresponds to a center of top surface 23. Bottom surface 211 of depression 21 is not flat. In depression 21, there is a difference in depth at least between a central portion of bottom surface 211 and a periphery of bottom surface 211. In the present exemplary embodiment, there is a step between the central portion of bottom surface 211 and the periphery of bottom surface 211, and the central portion of bottom surface 211 is lower than the periphery of bottom surface 211. In other words, in depression 21, the central portion is deeper than the periphery. Four corners of case 2 are chamfered, in a top view. However, the chamfering is not essential to push switch 1, and case 2 may not be appropriately chamfered.

Bottom surface 211 of depression 21 has contact portions 212 at a periphery of bottom surface 211 (see FIGS. 3A and 3B). Contact portions 212 are portions of bottom surface 211 of depression 21. Movable component 3 is in contact with contact portions 212. In the present exemplary embodiment, a plurality of areas (four areas in the present exemplary embodiment) of movable component 3 are in contact with bottom surface 211 of depression 21. Therefore, case 2 has the plurality of (four in the present exemplary embodiment) contact portions 212. Four contact portions 212 are at four corners of bottom surface 211 of depression 21.

Top surface 23 of case 2 is a surface in a thickness direction of case 2. Top surface 23 also has enlarging depressions 22. Enlarging depressions 22 are adjacent to respective contact portions 212 of bottom surface 211 of depression 21. Enlarging depressions 22 each have a shape that enlarges depression 21. Enlarging depressions 22 are outside respective contact portions 212 (are opposite a center of bottom surface 211), and thus enlarges depression 21. In FIGS. 3A and 3B, imaginary lines L1 represent boundaries between depression 21 and enlarging depressions 22. That is to say, depression 21 is inside imaginary lines L1 (is on a side of a center of bottom surface 211 relative to imaginary lines L1) in FIG. 3A. Further, enlarging depressions 22 are outside imaginary lines L1 (are opposite the center of bottom surface 211) in FIG. 3A.

The plurality of (four in the present exemplary embodiment) enlarging depressions 22 are adjacent to the plurality of (four in the present exemplary embodiment) respective contact portions 212. That is to say, in the present exemplary embodiment, case 2 has depression 21 and the plurality of enlarging depressions 22. Further, depression 21 and enlarging depressions 22 are integrally made. The plurality of enlarging depressions 22 are outside four corners of a periphery of depression 21, in a top view. The plurality of enlarging depressions 22 increase an area of an opening of depression 21. Enlarging depressions 22 form spaces where scraped powder P1 that has been generated in depression 21 enters. The details will be described in section "(2.3) Countermeasure against scraped powder".

Metal components 9 include first metal component 91 and second metal component 92. First metal component 91 and second metal component 92 are each a conductive metal sheet. Case 2 retains first metal component 91 and second metal component 92. In the present exemplary embodiment, first metal component 91 and second metal component 92, and case 2 are integrally made by insert molding. That is to say, case 2 that contains inserts that are metal components 9 (first metal component 91 and second metal component 92) is made by insert molding.

First metal component 91 has (first) stationary contact 7 and first terminal 11. Stationary contact 7 protrudes upward from a top surface of first metal component 91. Stationary contact 7 is substantially circular, in a top view. Second metal component 92 has (second) stationary contact 921 and second terminal 12. Bottom surface 211 of depression 21 exposes stationary contact 7 and stationary contact 921. Depression 21 exposes stationary contact 7 at a central portion of depression 21. Depression 21 exposes stationary contact 921 at a periphery of depression 21. Stationary contact 7 protrudes upward from bottom surface 211 of depression 21. An area of first metal component 91 around stationary contact 7 is substantially flush with bottom surface 211. Further, stationary contact 921 is substantially flush with bottom surface 211. Bottom surfaces 221 of four enlarging depressions 22 also expose stationary contact 921.

One of metal components 9 has pin receiving portions 93 at positions that correspond to enlarging depressions 22. Retaining pins Y1 (see FIG. 6) are in contact with pin receiving portions 93 to retain the one of metal components 9 when case 2 is molded (is made by insert molding). Stationary contact 921 has pin receiving portions 93 in the present exemplary embodiment because enlarging depressions 22 expose stationary contact 921 of second metal component 92. In the present exemplary embodiment, a case is exemplified in which retaining pins Y1 are in contact with an underside of the one of metal components 9 (stationary contact 921). Therefore, pin receiving portions 93 are under the underside of the one of metal components 9.

First terminal 11 protrudes from a right side of case 2. Second terminal 12 protrudes from a left side of case 2. More specifically, first terminal 11 protrudes rightward from the right side of case 2. Further, second terminal 12 protrudes leftward from the left side of case 2. An underside of first terminal 11 and an underside of second terminal 12 are flush with an underside of case 2. First terminal 11 and second terminal 12 are mechanically joined to and electrically connected with conductive components on a printed circuit board by soldering, respectively, for example.

Stationary contact 7 is electrically connected with first terminal 11 by part of first metal component 91 that is embedded in case 2. Similarly, stationary contact 921 is electrically connected with second terminal 12 by part of second metal component 92 that is embedded in case 2. First metal component 91 is electrically insulated from second metal component 92.

Stationary contact 7 has contact surface 73 (a top surface in the present exemplary embodiment) that is opposite movable contact 8. A shape of stationary contact 7 will be described in detail in section "(2.4) Stationary contact". Further, stationary contact 7 has grooves 74 that divide contact surface 73 into a plurality of areas 731 (see FIG. 9).

Figure 4A:
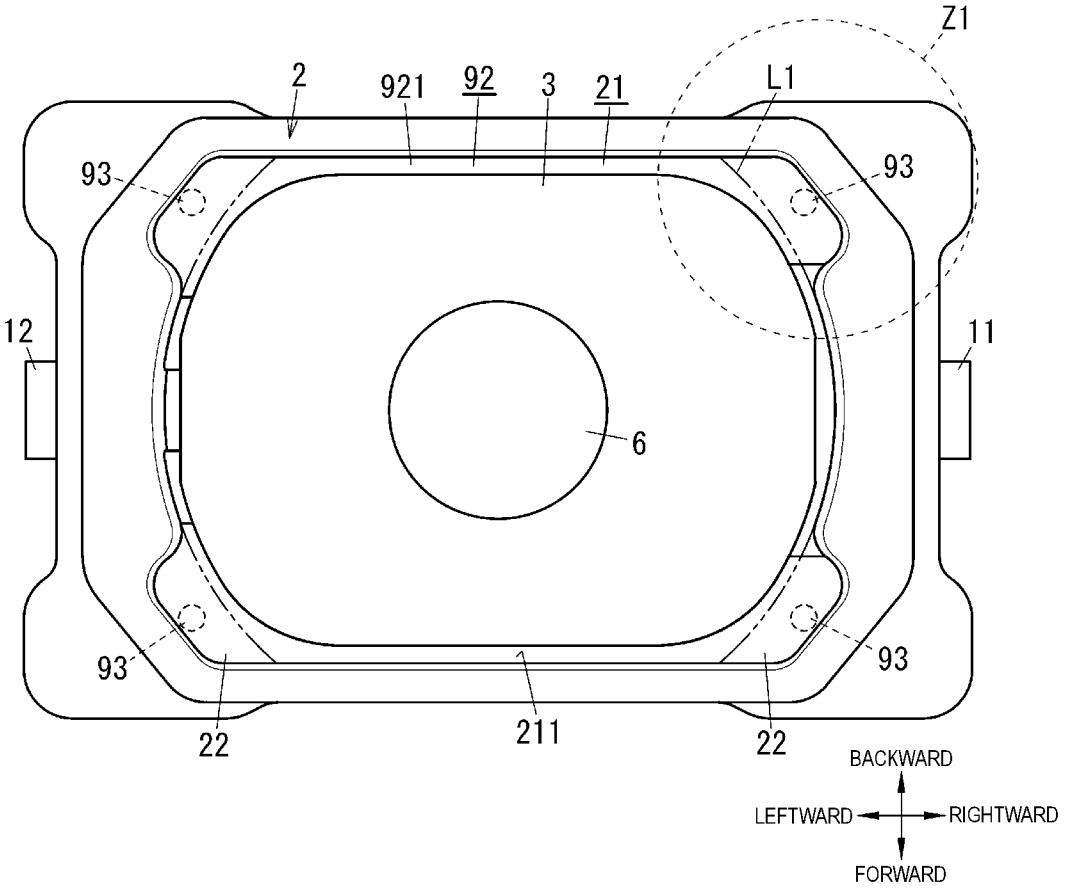
FIG. 4A is a plan view of the push switch according to the exemplary embodiment of the present disclosure.
Figure 4B:
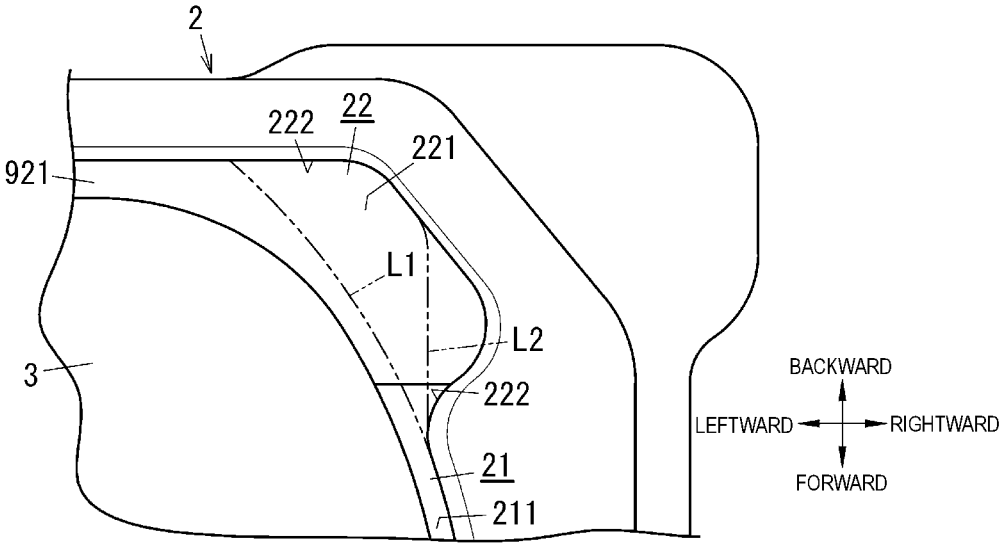
FIG. 4B is an enlarged view of area Z1 in FIG. 4A.

Movable component 3 is disposed in depression 21 of case 2, as illustrated in FIGS. 4A and 4B. Movable component 3 includes elastic sheets, such as metal sheets, for example, stainless-steel (SUS). In the present exemplary embodiment, movable component 3 includes a plurality of (three in the present exemplary embodiment) leaf springs 30 stacked together. The plurality of leaf springs 30 have a substantially same shape.

Movable component 3 has a shape that corresponds to depression 21. Further, movable component 3 is slightly smaller than depression 21, and thus can be disposed in depression 21. That is to say, in the present exemplary embodiment, movable component 3 has a shape like an ellipse whose lateral length is longer than a vertical length of the ellipse, in a top view. A top surface of movable component 3 (a top surface of uppermost leaf spring 30) has a central portion that forms pressure receiving portion 33 (see FIG. 1). That is to say, the central portion of the top surface of movable component 3 functions as pressure receiving portion 33. Pressure receiving portion 33 receives force applied from an outside of push switch 1 to push switch 1 when push switch 1 is operated (hereinafter referred to as "operational force").

Movable component 3 has a shape like a dome curved in such manner that a central portion of movable component 3 protrudes upward. While movable component 3 is disposed in depression 21, four corners of movable component 3 are in contact with bottom surface 211 of depression 21, in a top view. That is to say, four areas of movable component 3 are in contact with contact portions 212 of bottom surface 211 of depression 21, respectively. However, another area or other areas of movable component 3 may be in contact with bottom surface 211.

Figure 5A:
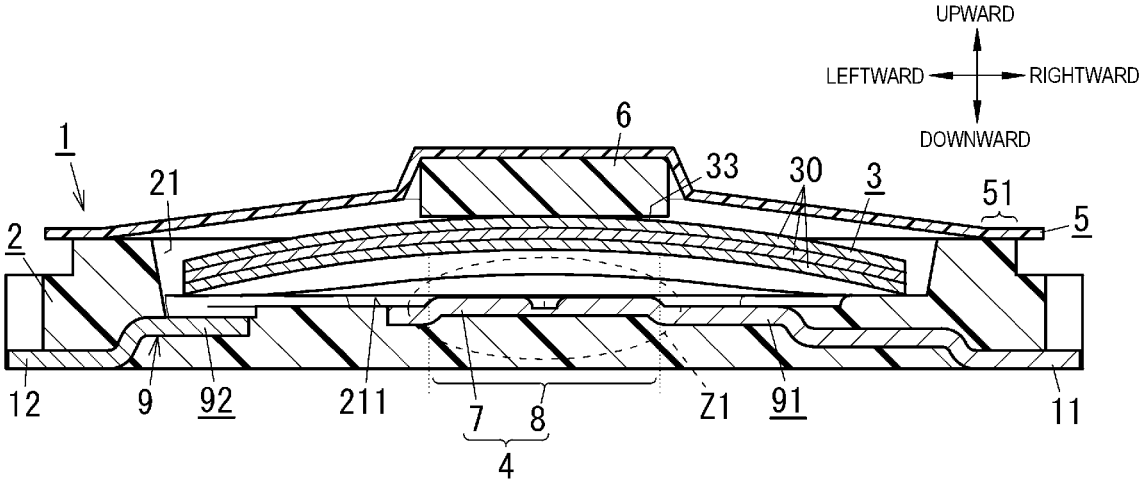
FIG. 5A is a schematic cross-sectional view of the push switch according to the exemplary embodiment of the present disclosure.
Figure 5B:
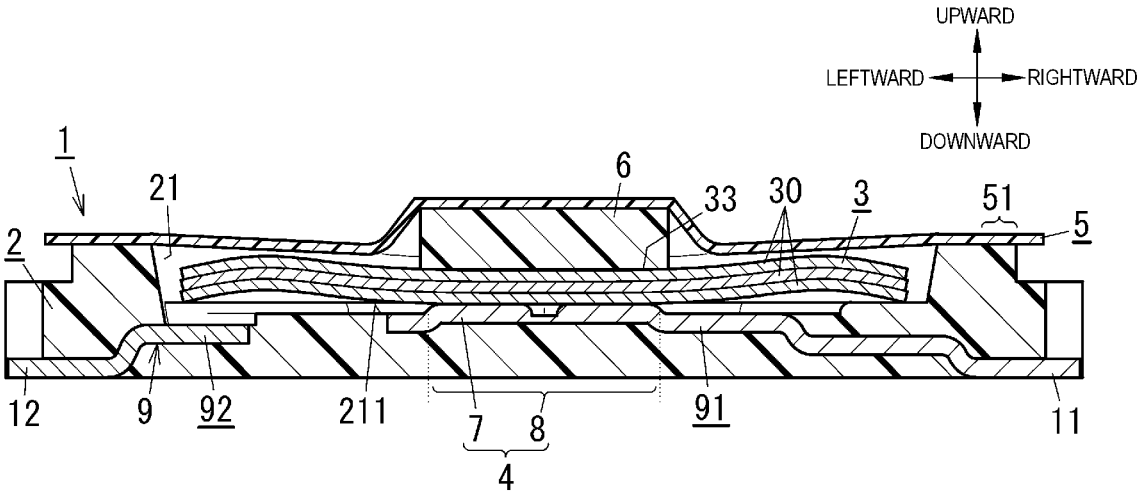
FIG. 5B is a schematic cross-sectional view of the push switch according to the exemplary embodiment of the present disclosure.

An underside of movable component 3 (an underside of lowermost leaf spring 30) is plated with gold (Au) or silver (Ag), for example. Consequently, a conductive film is made on the whole underside of movable component 3. Part of the conductive film that corresponds to a central portion of movable component 3 (pressure receiving portion 33) forms movable contact 8. At least four areas of movable component 3 are electrically connected with stationary contact 921 exposed by bottom surface 211. The at least four areas of movable component 3 are in contact with contact portions 212 of bottom surface 211. When operational force acts on pressure receiving portion 33, movable component 3 deforms and is bent downward. The details will be described in section "(2.2) Operations". For example, movable component 3 deforms into a shape like a dome, as illustrated in FIG. 5B. Consequently, a central portion of movable component 3 protrudes downward. At that time, movable contact 8 made on an underside of pressure receiving portion 33 comes into contact with stationary contact 7. Consequently, movable contact 8 is electrically connected with stationary contact 7.

That is to say, movable contact 8 and stationary contact 7 constitute contacts 4. When pressure receiving portion 33 is pushed toward bottom surface 211 of depression 21, movable component 3 deforms. Consequently, contacts 4 are closed or opened. More specifically, while operational force does not act on pressure receiving portion 33, movable contact 8 is apart from stationary contact 7. Therefore, contacts 4 are open. At that time, first metal component 91 is electrically insulated from second metal component 92. Therefore, first terminal 11 is not connected with second terminal 12. On the other hand, when operational force acts on pressure receiving portion 33, movable contact 8 comes into contact with stationary contact 7. Consequently, contacts 4 are closed. At that time, movable component 3 (or the conductive film made on an underside of movable component 3) electrically connects first metal component 91 with second metal component 92. Therefore, first terminal 11 is connected with second terminal 12.

Protective sheet 5 is a flexible sheet made of a synthetic resin. In the present exemplary embodiment, protective sheet 5 is made of a resin film that possesses heat resistance and electrical insulation. Protective sheet 5 is disposed on top surface 23 of case 2. Protective sheet 5 covers whole depression 21. Protective sheet 5 is joined to top surface 23 of case 2. Consequently, protective sheet 5 closes an opening surface of depression 21. Consequently, protective sheet 5 tightly closes depression 21. Consequently, protective sheet 5 does not allow water and a flux to enter depression 21. Consequently, protective sheet 5 protects contacts 4 and movable component 3 that are disposed in depression 21 against water and a flux. For example, a shape of a periphery of protective sheet 5 is substantially a same as a shape of a periphery of top surface 23 of case 2, and is slightly larger than top surface 23. A size of protective sheet 5 is at least a size that allows a portion (joined-portion 51) of protective sheet 5 to be joined to case 2.

Protective sheet 5 has joined-portion 51 at a periphery of protective sheet 5. Joined-portion 51 is joined to part of top surface 23 of case 2. The part of top surface 23 of case 2 is a periphery of depression 21 and peripheries of enlarging depressions 22. Joined-portion 51 is welded to case 2. Therefore, an adhesive does not adhere to an underside of protective sheet 5. The adhesive adheres to an underside of protective sheet 5 if joined-portion 51 and case 2 are joined together with the adhesive. In the present exemplary embodiment, joined-portion 51 is joined to top surface 23 of case 2 by laser welding. A method by which joined-portion 51 is joined to case 2 is not limited to welding. Joined-portion 51 may be joined to case 2 with an adhesive. Alternatively, part of joined-portion 51 may be joined to case 2 by welding, and part of joined-portion 51 may be joined to case 2 with an adhesive.

Pressing component 6 is disposed between protective sheet 5 and pressure receiving portion 33 of movable component 3. Pressing component 6 is made of a synthetic resin, and possesses electrical insulation. Pressing component 6 has a shape like a disk. Pressing component 6 has a thin thickness and has a flat top surface and a flat underside. Pressing component 6 is disposed on a top surface of movable component 3. An underside of pressing component 6 is in contact with pressure receiving portion 33. A top surface of pressing component 6 is joined to an underside of a central portion of protective sheet 5 by laser welding, for example. Pressing component 6 transfers operational force applied to protective sheet 5 to pressure receiving portion 33 of movable component 3. That is to say, when operational force acts on a top surface of protective sheet 5, pressing component 6 transfers the operational force to pressure receiving portion 33. Consequently, the operational force acts on a top surface of pressure receiving portion 33. The above configuration allows pressure receiving portion 33 to be indirectly operated with pressing component 6 by pressing protective sheet 5. A shape of pressing component 6 is not limited to a shape like a disk but may be a shape like a funnel.

(2.2) Operations

Next, operations of push switch 1 configured as described above will be described with reference to FIGS. 5A and 5B. FIG. 5A is a cross-sectional view taken along line X1-X1 in FIG. 2A.

Push switch 1 is normally open. When push switch 1 is operated, contacts 4 are closed. When push switch 1 is operated, a central portion of protective sheet 5 is pushed. Consequently, protective sheet 5 transfers downward operational force to pressing component 6. The expression "is pushed" means an operation that pushes a central portion of protective sheet 5 toward bottom surface 211 of depression 21 (downward).

When pressing component 6 transfers operational force to a top surface of pressure receiving portion 33, pressure receiving portion 33 is pushed toward bottom surface 211 of depression 21 (downward). Consequently, movable component 3 gradually deforms. If magnitude of the operational force transferred to pressure receiving portion 33 exceeds a predetermined value, movable component 3 quickly buckles and largely deforms, as illustrated in FIG. 5B. At that time, elastic force of movable component 3 that acts on pressure receiving portion 33 quickly varies. What is called reversal of movable component 3 deforms movable component 3 into a shape like a dome curved in such a manner that a central portion (pressure receiving portion 33) of movable component 3 protrudes downward, as illustrated in FIG. 5B. Therefore, the deformation of movable component 3 provides click feeling to a user (operator) who pushes push switch 1. When movable component 3 deforms into a shape like a dome that protrudes downward, movable contact 8 on an underside of movable component 3 comes into contact with stationary contact 7, as illustrated in FIG. 5B. Consequently, contacts 4 are closed. In this state, first terminal 11 is connected with second terminal 12.

On the other hand, if movable component 3 has deformed into a shape like a dome that protrudes downward, and then operational force ceases to act on pressure receiving portion 33, restoring force of movable component 3 restores movable component 3 to (movable component 3 deforms into) a shape like a dome curved in such a manner that a central portion (pressure receiving portion 33) of movable component 3 protrudes upward. At that time, elastic force of movable component 3 that acts on pressure receiving portion 33 quickly varies. Therefore, movable component 3 quickly returns to (deforms into) an original shape (a shape like a dome curved in such a manner that a central portion of movable component 3 protrudes upward). Therefore, the deformation of movable component 3 also provides click feeling to a user (operator) who pushes push switch 1 when the user ceases to push push switch 1. Then, when movable component 3 deforms into a shape like a dome that protrudes upward, movable contact 8 on an underside of movable component 3 becomes apart from stationary contact 7, as illustrated in FIG. 5A. Consequently, contacts 4 are opened. In this state, first terminal 11 is not connected with second terminal 12.

(2.3) Countermeasure Against Scraped Powder

Hereinafter, a structure that push switch 1 includes as a countermeasure against scraped powder P1 will be described in detail with reference to FIGS. 3A and 3B. Scraped powder P1 is schematically illustrated for explanation in FIG. 3B, for example. However, scraped powder P1 is not a component of push switch 1.

When push switch 1 according to the present exemplary embodiment is operated, movable component 3 deforms and may rub against bottom surface 211 of depression 21 of case 2. If excessive force is applied to movable component 3, for example, powder P1 may be scraped from case 2. Especially when an object collides with an operational button of a device that includes push switch 1 as one of controls, excessive force is more likely to be applied to movable component 3 than a case in which a user intentionally operates push switch 1. Consequently, powder P1 is more likely to be scraped. Further, the more times push switch 1 is used, the more likely powder P1 is to be scraped.

In the present exemplary embodiment, contact portions 212 of bottom surface 211 of depression 21 expose one of metal components 9, as described above. Movable component 3 is in contact with contact portions 212. Therefore, movable component 3 rubs mainly against the one of metal components 9 at contact portions 212. Therefore, powder P1 may be scraped from the one of metal components 9. In the present disclosure, the "scraped powder" is scraped from part of the one of metal components 9 since movable component 3 rubs against the one of metal components 9. However, scraped powder P1 is not only scraped from the one of metal components 9, but also may be scraped from case 2 made of a synthetic resin since movable component 3 rubs against part of case 2 made of a synthetic resin. Scraped powder P1 generated as described above may accumulate at contact portions 212 with which movable component 3 is in contact. Contact portions 212 are portions of bottom surface 211 of depression 21 of case 2. If scraped powder P1 accumulates at contact portions 212, scraped powder P1 may prevent movable component 3 from moving, or scraped powder P1 may enter between movable component 3 and stationary contact 921. Consequently, scraped powder P1 may vary tactility and electrical properties of push switch 1.

In push switch 1 according to the present exemplary embodiment, case 2 has enlarging depressions 22, as illustrated in FIGS. 3A and 3B. Therefore, push switch 1 according to the present exemplary embodiment deals with scraped powder P1 described above. That is to say, enlarging depressions 22 are adjacent to contact portions 212 with which movable component 3 is in contact. Contact portions 212 are portions of bottom surface 211 of depression 21. Therefore, if deformation of movable component 3 generates scraped powder P1 at contact portions 212, scraped powder P1 enters enlarging depressions 22. In other words, scraped powder P1 that has been generated at contact portions 212 in depression 21 moves from contact portions 212 into enlarging depressions 22 that is connected with contact portions 212, respectively, as illustrated in FIG. 3B. The above configuration allows enlarging depressions 22 to function as pockets in which scraped powder P1 that has been generated in depression 21 accumulates. Therefore, in push switch 1, scraped powder P1 is less likely to accumulate at contact portions 212 with which movable component 3 is in contact. Contact portions 212 are portions of bottom surface 211 of depression 21 of case 2. Therefore, scraped powder P1 is less likely to vary tactility and electrical properties of push switch 1.

In the present exemplary embodiment, a side surface of each of enlarging depressions 22 has a pair of side surfaces 222, as illustrated in FIG. 3B. The pair of side surfaces 222 are inclined. Therefore, in a plane that is along bottom surface 211 of depression 21, the farther from depression 21, the smaller an area of an opening of each of enlarging depressions 22. In other words, the closer to depression 21, the larger an area of an opening of each of enlarging depressions 22 becomes due to the pair of side surfaces 222.

That is to say, in a top view, the farther from depression 21, the shorter a distance between the pair of side surfaces 222 of each of enlarging depressions 22 that are adjacent to depression 21.

Further, in the present exemplary embodiment, one of the pair of side surfaces 222 (side surface 222 that is closer to a back side in FIG. 3B) is flush with side surface 213*a* of depression 21. The other one of the pair of side surfaces 222 (side surface 222 that is closer to a front side in FIG. 3B) is curved and is connected with side surface 213*b* of depression 21.

The configuration allows the pair of side surfaces 222 of each of enlarging depressions 22 to function as a structure that guides scraped powder P1 from depression 21 into enlarging depressions 22. Therefore, push switch 1 according to the present exemplary embodiment has an advantage that scraped powder P1 that has been generated at contact portions 212 of depression 21 is more likely to enter enlarging depressions 22.

In the present exemplary embodiment, movable component 3 has a lateral length that is longer than a vertical length of movable component 3, in a top view. In such a case, preferably, a space in each of enlarging depressions 22 has a lateral length that is longer than a vertical length of the space in each of enlarging depressions 22, as illustrated in FIG. 4B. That is to say, if each of enlarging depressions 22 enlarged depression 21 equally in both vertically (backward in FIG. 4B) and laterally (rightward in FIG. 4B), imaginary line L2 in FIG. 4B would be a side surface of each of enlarging depressions 22.

If movable component 3 has a lateral length that is longer than a vertical length of movable component 3, in a top view, an amount of lateral movement of movable component 3 relative to each of contact portions 212 is larger than an amount of vertical movement of movable component 3 relative to each of contact portions 212 when operational force acts on pressure receiving portion 33 of movable component 3. Therefore, scraped powder P1 is more likely to be generated laterally outside contact portions 212 than vertically outside contact portions 212. Therefore, in the present exemplary embodiment, each of enlarging depressions 22 additionally enlarges depression 21 laterally (rightward in FIG. 4B) from imaginary line L2. Therefore, scraped powder P1 that has been generated laterally outside contact portions 212 (to a right of one of contact portions 212 in FIG. 4B) efficiently accumulates in enlarging depressions 22.

In the present exemplary embodiment, case 2 is made of a synthetic resin, and bottom surface 211 of depression 21 exposes metal components 9. In that case, preferably, one of metal components 9 extends to bottom surfaces 221 of enlarging depressions 22. That is to say, the one of metal components 9 extends from each of contact portions 212 of bottom surface 211 of depression 21 to bottom surface 221 of corresponding one of enlarging depressions 22. Movable component 3 is in contact with contact portions 212. Consequently, even if movable component 3 moves onto boundaries between depression 21 and each of enlarging depressions 22 (imaginary lines L1), movable component 3 does not rub against case 2 made of a synthetic resin. Therefore, powder P1 is less likely to be scraped from case 2 made of a synthetic resin.

Figure 6:
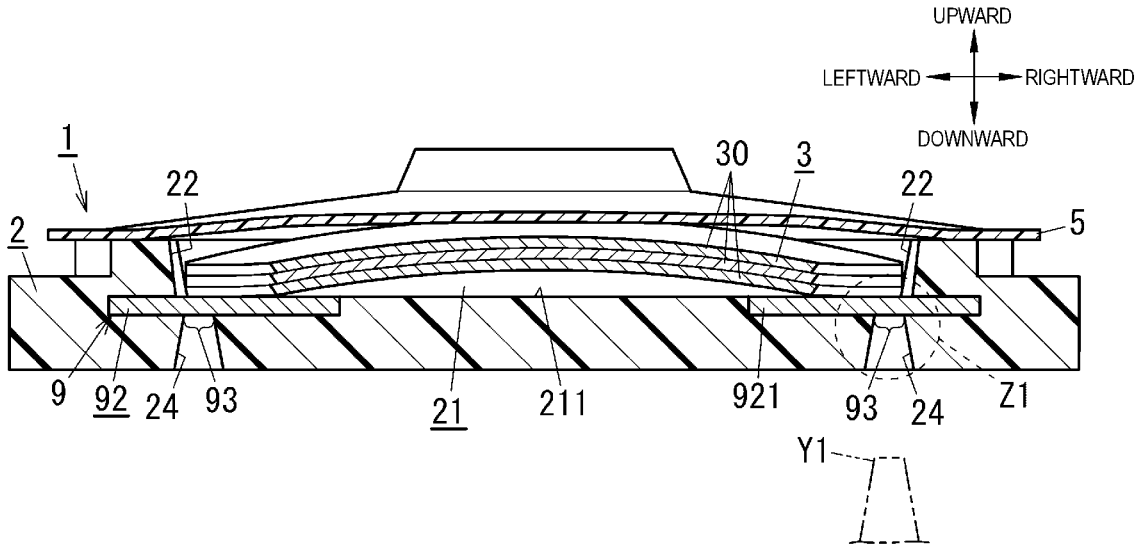
FIG. 6 is a schematic cross-sectional view of the push switch according to the exemplary embodiment of the present disclosure taken along line X2-X2 in FIG. 2A.

Further, in the present exemplary embodiment, the one of metal components 9 has pin receiving portions 93 at positions that correspond to enlarging depressions 22, as described above. Pin receiving portions 93 of the one of metal components 9 may deform because retaining pins Y1 (drawn using a two-dot chain line) are in contact with pin receiving portions 93 while case 2 is molded, as illustrated in FIG. 6. FIG. 6 is a cross-sectional view taken along line X2-X2 in FIG. 2A. In an example in FIG. 6, retaining pins Y1 are inserted in pin holes 24 that extend through an underside of case 2, respectively. Bottom surfaces of pin holes 24 expose pin receiving portions 93, respectively. Surfaces of ends of retaining pins Y1 are in contact with pin receiving portions 93, respectively. If pin receiving portions 93 were at positions with which movable component 3 is in contact, such as contact portions 212, deformation of pin receiving portions 93 would prevent movable component 3 from moving. In the present exemplary embodiment, pin receiving portions 93 are at positions that correspond to enlarging depressions 22. Therefore, deformation of pin receiving portions 93 does not prevent movable component 3 from moving. That is to say, enlarging depressions 22 function as pockets in which scraped powder P1 that has been generated in depression 21 accumulates, as described above. Therefore, movable component 3 basically is not in contact with bottom surfaces 221 of enlarging depressions 22. Therefore, deformation of pin receiving portions 93 does not prevent movable component 3 from moving.

Preferably, case 2 has the plurality of contact portions 212 with which movable component 3 is in contact, as in the present exemplary embodiment. Contact portions 212 are portions of bottom surface 211 of depression 21. Further, preferably, case 2 has the plurality of enlarging depressions 22 that are adjacent to the plurality of contact portions 212, respectively. That is to say, enlarging depressions 22 are separate from each other, and are for respective contact portions 212. Therefore, scraped powder P1 that has been generated at each of contact portions 212 efficiently accumulates in enlarging depressions 22.

Figure 8A:
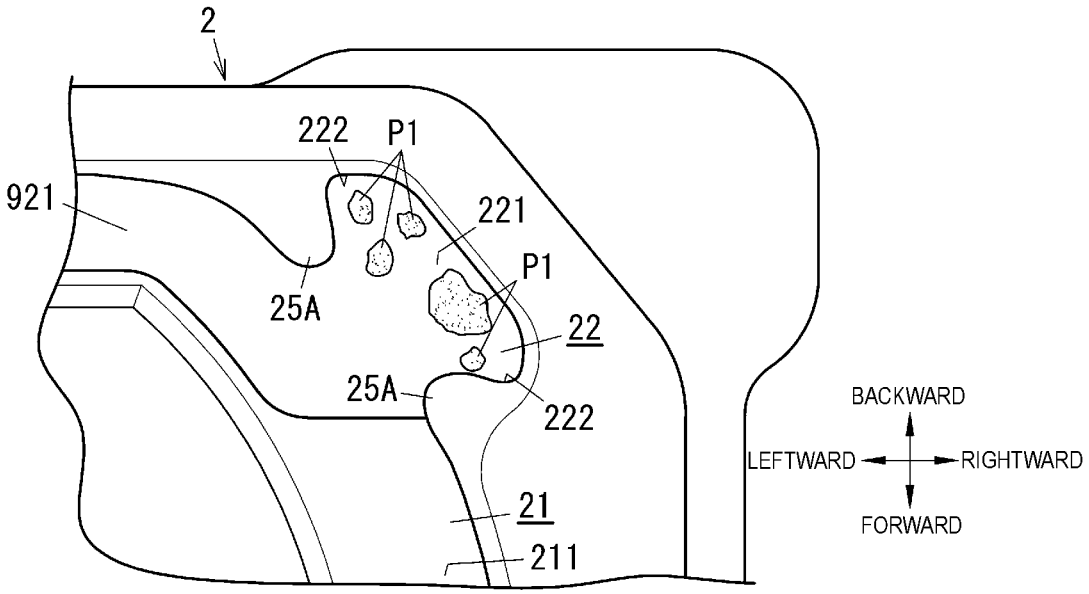
FIG. 8A is a plan view of an important part that illustrates an aspect of one of enlarging depressions of the push switch according to the exemplary embodiment of the present disclosure.
Figure 8B:
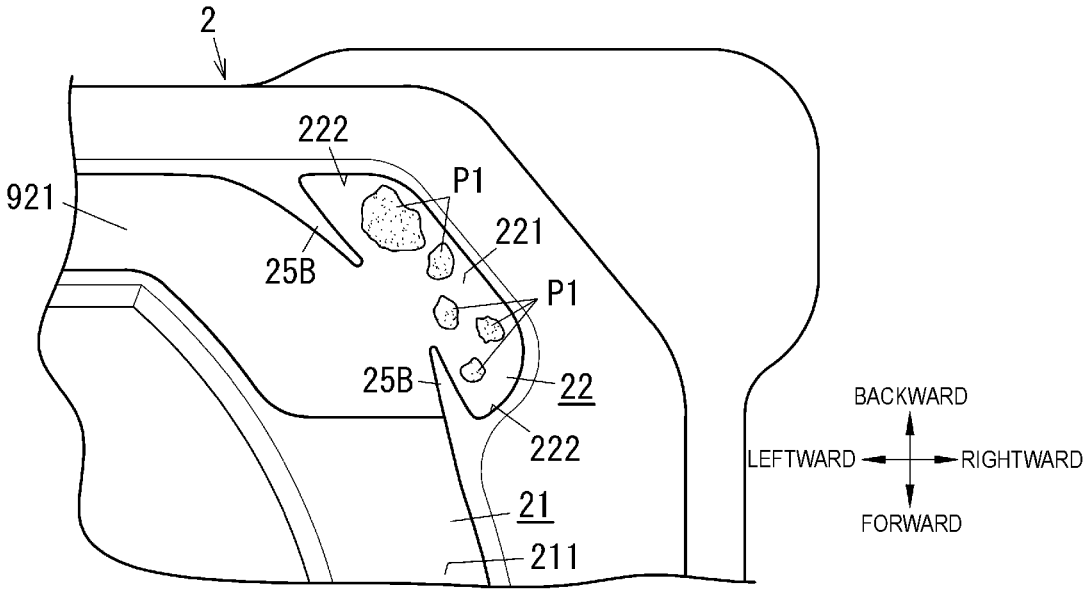
FIG. 8B is a plan view of an important part that illustrates an aspect of one of enlarging depressions of the push switch according to the exemplary embodiment of the present disclosure.

Push switch 1 may include enlarging depressions 22 configured as exemplified in FIGS. 7A to 8B. FIGS. 7A and 7B are enlarged views of an important part that corresponds to area Z1 in FIG. 6. However, components that are not directly related to the following description, such as movable component 3, are appropriately not illustrated in FIGS. 7A and 7B. FIGS. 8A and 8B are enlarged views of an important part that corresponds to area Z1 in FIG. 3A.

In an example illustrated in FIG. 7A, surface roughness of bottom surfaces 221 of enlarging depressions 22 is at least higher than surface roughness of contact portions 212 of bottom surface 211 of depression 21. That is to say, bottom surfaces 221 of enlarging depressions 22 are at least rougher than contact portions 212 of bottom surface 211 of depression 21. More specifically, bottom surfaces 221 of enlarging depressions 22 are processed by knurling or embossing, for example. Consequently, surface roughness of bottom surfaces 221 of enlarging depressions 22 is higher than surface roughness of bottom surface 211 of depression 21. Consequently, scraped powder P1 that has moved from depression 21 into enlarging depressions 22 is captured by bottom surfaces 221 of enlarging depressions 22. Therefore, scraped powder P1 is more likely to stay in enlarging depressions 22. Consequently, scraped powder P1 is less likely to move from enlarging depressions 22 into depression 21.

A top surface of part of metal component 92 exposed by the bottom surface of depression 21 of case 2 forms part of bottom surface 211 of depression 21, as illustrated in FIGS. 7A and 7B. A top surface of part of metal component 92 exposed by the bottom surfaces of enlarging depressions 22 of case 2 forms part of bottom surfaces 221 of enlarging depressions 22, as illustrated in FIGS. 7A and 7B.

In an example illustrated in FIG. 7B, depth D2 of enlarging depressions 22 is at least larger than depth D1 of depression 21 at contact portions 212 (D2>D1). Depth D2 of enlarging depressions 22 is a distance from top surface 23 of case 2 to bottom surfaces 221 of enlarging depressions 22. Depth D1 of depression 21 is a distance from top surface 23 of case 2 to bottom surface 211 of depression 21. That is to say, bottom surfaces 221 of enlarging depressions 22 are at least lower than contact portions 212 of bottom surface 211 of depression 21. Further, there is a step between bottom surface 221 of each of enlarging depressions 22 and corresponding one of contact portions 212 of bottom surface 211 of depression 21.

That is to say, when enlarging depressions 22 and depression 21 are seen from above (seen in a first direction), bottom surfaces 221 of enlarging depressions 22 are lower than bottom surface 211 of depression 21 (contact portions 212) (bottom surfaces 221 of enlarging depressions 22 are more in a second direction than bottom surface 211 of depression 21 (contact portions 212) is in the second direction).

Consequently, scraped powder P1 that has moved from depression 21 into enlarging depressions 22 is captured by bottom surfaces 221 of enlarging depressions 22. Therefore, scraped powder P1 is more likely to stay in enlarging depressions 22. Consequently, scraped powder P1 is less likely to move from enlarging depressions 22 into depression 21. The configuration illustrated in FIG. 7B and the configuration illustrated in FIG. 7A may be combined and applied.

In an example illustrated in FIG. 8A, case 2 has walls 25A each of which is between each of enlarging depressions 22 and depression 21. In an example illustrated in FIG. 8B, case 2 has walls 25B each of which is between each of enlarging depressions 22 and depression 21. In the example in FIG.

8A, the pair of walls 25A protrude from a pair of side surfaces 222, respectively. Further, the pair of walls 25A protrude toward each other. Similarly, in the example in FIG. 8B, the pair of walls 25B protrude from a pair of side surfaces 222, respectively. Further, the pair of walls 25B protrude toward each other. Especially in the example in FIG. 8B, the pair of walls 25B diagonally protrude from the pair of side surfaces 222 toward an inside of corresponding one of enlarging depressions 22, in a top view. Walls 25A, 25B decrease an area of an opening facing depression 21, of each of enlarging depressions 22. Consequently, if scraped powder P1 moves from depression 21 into enlarging depressions 22, walls 25A, 25B regulate movement of scraped powder P1 toward depression 21. Therefore, scraped powder P1 is more likely to stay in enlarging depressions 22. Consequently, scraped powder P1 is less likely to move from enlarging depressions 22 into depression 21. Especially in a configuration in FIG. 8B, the pair of walls 25B diagonally protrude toward an inside of corresponding one of enlarging depressions 22. Therefore, scraped powder P1 is much less likely to move from enlarging depressions 22 into depression 21.

Walls 25A are not necessarily in pairs. Further, walls 25B are not necessarily in pairs.

(2.4) Stationary Contact

Hereinafter, (first) stationary contact 7 will be described in detail with reference to FIGS. 9 to 10C. FIG. 10B is an enlarged view of area Z1 in FIG.

10A. FIG. 10C is an enlarged view of area Z1 in FIG. 10B. FIGS. 10B and 10C are cross-sectional views that each schematically illustrate only stationary contact 7. Therefore, various dimensional relations (e.g., a thickness of base material 71 and a thickness of conductive layer 72) in FIGS. 10B and 10C are different from actual dimensional relations.

Stationary contact 7 includes base material 71 (see FIG. 10B) and conductive layer 72 (see FIG. 10B) that covers base material 71. In the present exemplary embodiment, conductive layer 72 covers a whole top surface (contact surface 73) of base material 71. Base material 71 is a copper alloy, such as phosphor bronze. Conductive layer 72 is a plated layer. Conductive layer 72 includes silver (Ag), for example. For example, nickel (Ni) is plated on a surface of base material 71 made of phosphor bronze to make a plated base layer. Further, silver (Ag) is plated on the plated base layer to make a plated silver layer. In that case, conductive layer 72 includes the plated base layer, and the plated silver layer.

Stationary contact 7 has contact surface 73 (a top surface in the present exemplary embodiment) that is opposite movable contact 8. Movable contact 8 is disposed opposite contact surface 73 of stationary contact 7. Movable contact 8 moves between a closed position (first position) where movable contact 8 is in contact with contact surface 73 and an open position (second position) where movable contact 8 is apart from contact surface 73. That is to say, contacts 4 are closed when movable contact 8 is at the closed position (first position) (see FIG. 5B). Alternatively, contacts 4 are open when movable contact 8 is at the open position (second position) (see FIG. 5A).

Stationary contact 7 has protrusion 70 that protrudes from a base surface. Contact surface 73 is a surface of an end of protrusion 70, as illustrated in FIG. 9. The base surface is bottom surface 211 of depression 21. Protrusion 70 protrudes upward from bottom surface 211. Protrusion 70 is substantially circular, in a top view. That is to say, contact surface 73 is a top surface of protrusion 70 that protrudes upward from a top surface of first metal component 91. Further, protrusion 70 is substantially circular, in a top view.

Stationary contact 7 has grooves 74 that divide contact surface 73 into a plurality of areas 731. Grooves 74 include first groove 741 and second groove 742. First groove 741 and second groove 742 extend in different directions in a plane that is along contact surface 73. First groove 741 intersects with second groove 742 at substantially a center of contact surface 73. In FIG. 9, first groove 741 is a straight groove that extends forward right diagonally, in a top view. Further, second groove 742 is a straight groove that extends backward right diagonally, in a top view. First groove 741 intersects with second groove 742 substantially at a right angle. Consequently, grooves 74 have a shape like a cross. In the present exemplary embodiment, first groove 741 and second groove 742 that intersect with each other divide contact surface 73 into four areas 731. Preferably, a width of grooves 74 is larger than a depth of grooves 74. Preferably, a depth of grooves 74 is smaller than or equal to half (½) of a thickness of stationary contact 7 (first metal component 91).

Since grooves 74 divide contact surface 73 into the plurality of areas 731, a structure-for-contact-at-a-plurality-of-positions is made for contacts 4. The structure-for-contact-at-a-plurality-of-positions allows movable contact 8 to be in contact with a plurality of positions of stationary contact 7, as described above. Therefore, even if foreign matter enters between stationary contact 7 and movable contact 8, electrical properties of push switch 1 are less likely to deteriorate, compared with a case in which contact surface 73 of stationary contact 7 is one flat plane. Consequently, electrical properties of push switch 1 are less likely to vary. Therefore, reliability of contact increases.

If contacts 4 have the above structure-for-contact-at-a-plurality-of-positions, part of conductive layer 72 is likely to be removed from base material 71 of stationary contact 7 when excessive force is applied to movable component 3, for example. Further, the more times push switch 1 is used, the more likely conductive layer 72 is to be removed. A conceivable cause is damage to conductive layer 72 at opening edges 751 of grooves 74. Another conceivable cause is a stress concentration that occurs at opening edges 751 of grooves 74 when movable contact 8 is pushed against stationary contact 7. Especially if movable contact 8 is more tightly plated than stationary contact 7 is plated, part of conductive layer 72 (a plated layer) of stationary contact 7 adheres to movable contact 8. Consequently, part of conductive layer 72 is likely to be removed. For example, movable contact 8 is tightly plated if nickel (Ni) and copper are plated on a surface of a base material that is stainless steel (SUS) to make a plated base layer, and silver (Ag) is plated on the plated base layer to make a plated silver layer. If part of conductive layer 72 is removed, electrical properties of push switch 1 may vary.

As a countermeasure against such removal of conductive layer 72, push switch 1 according to the present exemplary embodiment includes stationary contact 7 configured as described below. That is to say, in the present exemplary embodiment, each of grooves 74 has connection surfaces 753 that connect respective opening edges 751 of each of grooves 74 with bottom 752 of each of grooves 74. Each of connection surfaces 753 has slope 754, as illustrated in FIGS. 10A to 10C. Each of slopes 754 is inclined at acute angles θ relative to contact surface 73 (see FIG. 10C). In the present disclosure, the "opening edges" are edges of an opening surface of each of grooves 74. Further, each of the "opening edges" is a boundary between contact surface 73 and each of grooves 74. Further, in the present disclosure, the "bottom" is a deepest portion in each of grooves 74. That is to say, the "bottom" is a lowest portion in each of grooves 74. Further, in the present disclosure, an "acute angle" is an angle that is larger than 0° and smaller than a right angle (90°).

In short, stationary contact 7 has connection surfaces 753 in grooves 74. Connection surfaces 753 connect respective opening edges 751 with bottom 752. In an example in FIG. 10B, bottom 752 of groove 74 is flat. Further, each of connection surfaces 753 is a curved surface that is curved in such a manner that the curved surface protrudes toward an inside of corresponding one of grooves 74. In other words, a corner between contact surface 73 and an inner surface of each of grooves 74 is rounded in an example in FIG. 10B. Each of connection surfaces 753 that has such a shape has a curved surface that has slope 754. Especially in the example in FIG. 10B, whole connection surfaces 753 are curved surfaces. Therefore, whole connection surfaces 753 are inclined at acute angles relative to contact surface 73. That is to say, whole connection surfaces 753 form slopes 754. Consequently, the farther from opening edges 751 toward a center of a width of each of grooves 74, the deeper a depth of each of grooves 74 becomes.

Figure 12A:
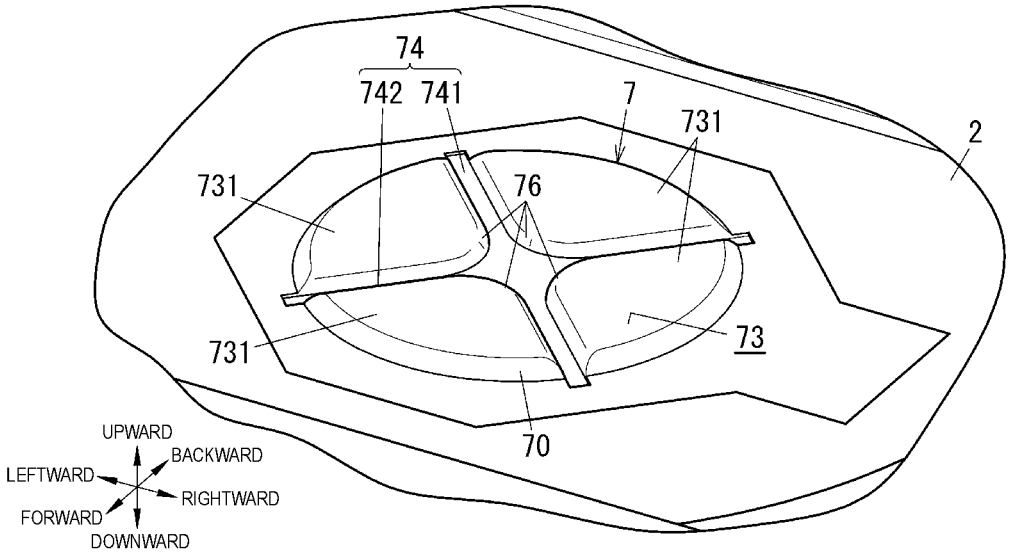
FIG. 12A is a perspective view of an important part that illustrates corners of the push switch according to the exemplary embodiment of the present disclosure. The corners each have a first shape.

Further, in the present exemplary embodiment, each of connection surfaces 753 has slope 754 also at each of corners 76 at a point of intersection between first groove 741 and second groove 742 (see FIG. 12A). That is to say, each of connection surfaces 753 has slope 754 at least at each of corners 76 at the point of intersection between first groove 741 and second groove 742. In the present exemplary embodiment, there are two pairs of corners 76 at the point of intersection between first groove 741 and second groove 742. That is to say, there are four corners 76 at the point of intersection between first groove 741 and second groove 742. Each of the two pairs of corners 76 are opposite each other. Two of four corners 76 are vertically opposite each other. The two other ones of four corners 76 are laterally opposite each other. At each of four corners 76, each of connection surfaces 753 is a curved surface that is curved in such a manner that the curved surface protrudes toward an inside of grooves 74. Especially in the present exemplary embodiment, at each of corners 76, each of connection surfaces 753 is a curved surface that is curved in such a manner that the curved surface protrudes toward an inside of grooves 74, at least in a plane that is along contact surface 73 (that is to say, in a plan view). Therefore, connection surfaces 753 have respective slopes 754 at any one of four corners 76. Further, since four corners 76 each have slope 754, areas of movable contact 8 that are in contact with four corners 76, respectively, are not points. That is to say, areas of movable contact 8 that are in contact with four areas 731 of stationary contact 7, respectively, are surfaces. Therefore, stationary contact 7 does not locally apply a large load to movable contact 8. Therefore, occurrences of a stress concentration at movable contact 8 are also reduced.

Conductive layer 72 includes first conductive layer 721 and second conductive layer 722, as illustrated in FIG. 10C. First conductive layer 721 is part of conductive layer 72 and is at contact surface 73. Second conductive layer 722 is part of conductive layer 72 and is at connection surfaces 753. Preferably, first conductive layer 721 is connected with second conductive layer 722. That is to say, if each of connection surfaces 753 is a curved surface that is curved in such a manner that the curved surface protrudes toward an inside of corresponding one of grooves 74, as in the present exemplary embodiment, there is no step at each of opening edges 751 of grooves 74. Therefore, in a method for manufacturing stationary contact 7 described later, damage is less likely to occur between first conductive layer 721 and second conductive layer 722 at each of opening edges 751. Therefore, first conductive layer 721 and second conductive layer 722 that are connected with each other are easily made.

In push switch 1 according to the present exemplary embodiment, the above configuration allows conductive layer 72 to be less likely to be damaged at opening edges 751 of grooves 74. Further, the above configuration allows a stress concentration to be less likely to occur at opening edges 751 of grooves 74 when movable contact 8 is pushed against stationary contact 7. Therefore, even if several tens of newtons are applied to movable component 3 of push switch 1 according to the present exemplary embodiment, for example, conductive layer 72 is less likely to be removed from base material 71. Further, even if push switch 1 is used several million times to several ten million times, conductive layer 72 is less likely to be removed from base material 71.

Next, an example of methods for manufacturing stationary contact 7 configured as described above will be described with reference to FIGS. 11A to 11C.

Figure 11A:
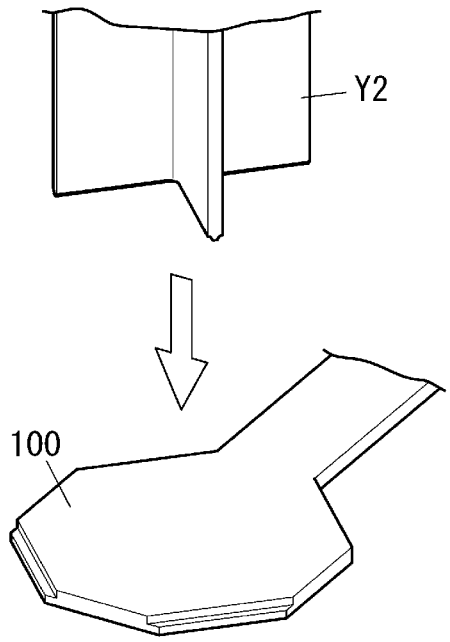
FIG. 11A is a schematic view that illustrates an example of a method for manufacturing a stationary contact of the push switch according to the exemplary embodiment of the present disclosure.
Figure 11B:
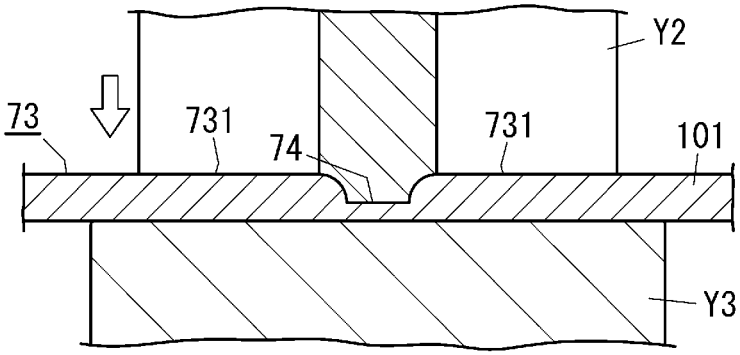
FIG. 11B is a schematic view that illustrates an example of the method for manufacturing the stationary contact of the push switch according to the exemplary embodiment of the present disclosure.

In the present exemplary embodiment, first, in a plating step, conductive layer 72 is plated on a surface of base material 71 to make metal sheet 100 that will become first metal component 91. Then, in a first pressing step, metal sheet 100 that includes conductive layer 72 is pressed to make grooves 74, as illustrated in FIGS. 11A and 11B. In the first pressing step, metal sheet 100 is disposed on pad Y3, and then metal sheet 100 is pressed from above with punch Y2 that has a shape like a cross. Consequently, metal sheet 101 that has grooves 74 is made.

Figure 11C:
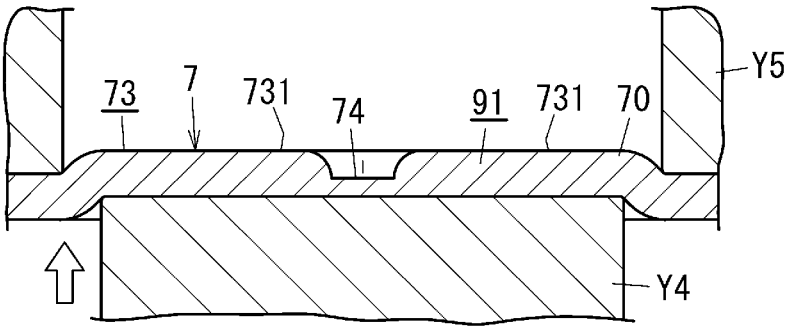
FIG. 11C is a schematic view that illustrates an example of the method for manufacturing the stationary contact of the push switch according to the exemplary embodiment of the present disclosure.

Then, in a second pressing step, metal sheet 101 is pressed to make protrusion 70, as illustrated in FIG. 11C. In the second pressing step, metal sheet 101 is pressed upward with punch Y4 that is cylindrical while a top surface of metal sheet 101 is pushed with die Y5 that is cylindrical. Consequently, first metal component 91 that has protrusion 70 is made.

Second conductive layer 722 (see FIG. 10C) is part of conductive layer 72 and is at connection surfaces 753. Second conductive layer 722 is stretched in the first pressing step of the above manufacturing method. Therefore, a thickness of second conductive layer 722 is smaller than a thickness of first conductive layer 721 (see FIG. 10C). That is to say, a thickness of first conductive layer 721 may be different from a thickness of second conductive layer 722.

The above manufacturing method is only an example. For example, after the first pressing step and the second pressing step, the plating step is performed to plate conductive layer 72 on a surface of base material 71. That is to say, the first pressing step, the second pressing step, and the plating step may be performed in this order. In the above manufacturing method, before the first pressing step, a metal sheet is blanked to form an outer shape of metal sheet 100 that will become first metal component 91. However, after the second pressing step, a metal sheet may be blanked to form an outer shape of first metal component 91, for example.

(2.5) Shapes of Corners of Stationary Contact

Next, shapes of each of corners 76 formed at a point of intersection between first groove 741 and second groove 742 in stationary contact 7 will be described in detail with reference to FIGS. 12A to 15. In an example described below, four corners 76 at a point of intersection between first groove 741 and second groove 742 have a same shape. Therefore, one corner 76 of four corners 76 will be described.

Figure 12B:
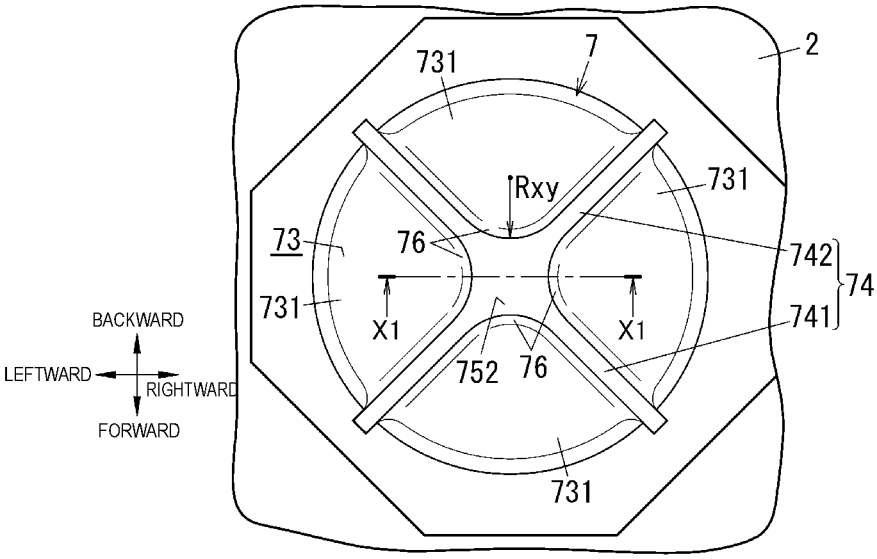
FIG. 12B is a plan view that illustrates the corners of the push switch according to the exemplary embodiment of the present disclosure. The corners each have the first shape.
Figure 12C:
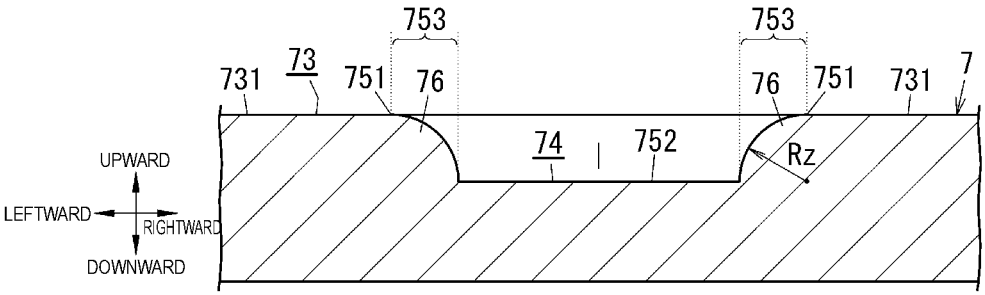
FIG. 12C is a schematic cross-sectional view of the corners of the push switch according to the exemplary embodiment of the present disclosure taken along line X1-X1 in FIG. 12B. The corners each have the first shape.
Figure 13A:
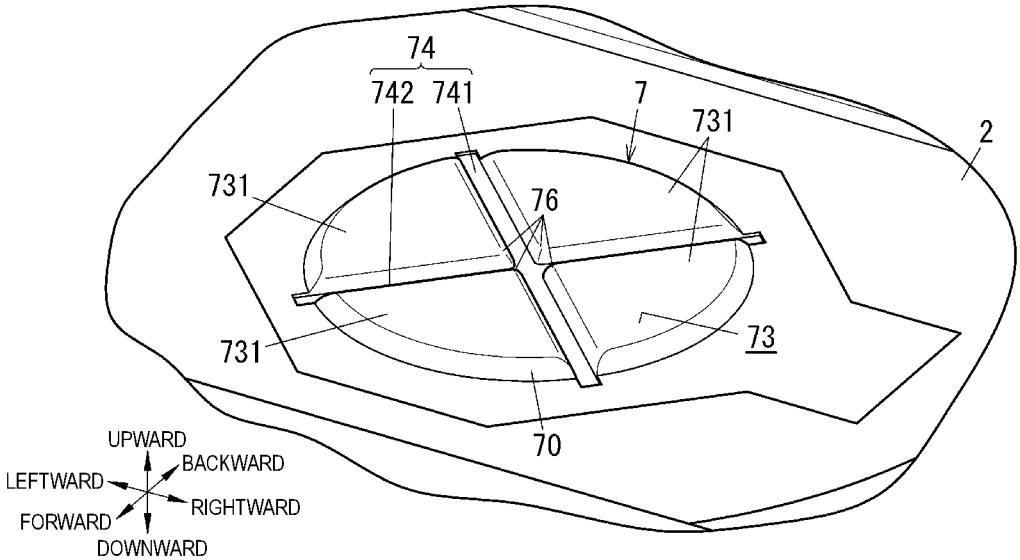
FIG. 13A is a perspective view of an important part that illustrates corners of the push switch according to the exemplary embodiment of the present disclosure. The corners each have a second shape.
Figure 13B:
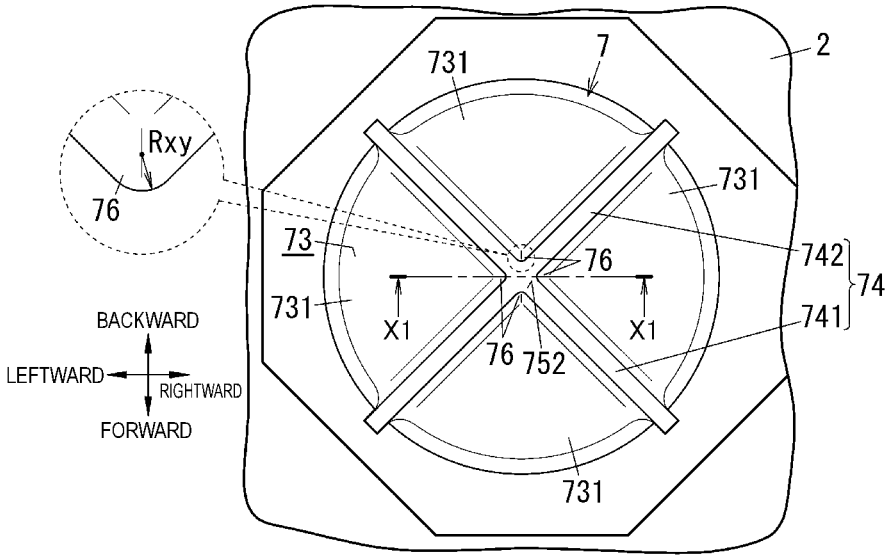
FIG. 13B is a plan view that illustrates the corners of the push switch according to the exemplary embodiment of the present disclosure. The corners each have the second shape.
Figure 13C:
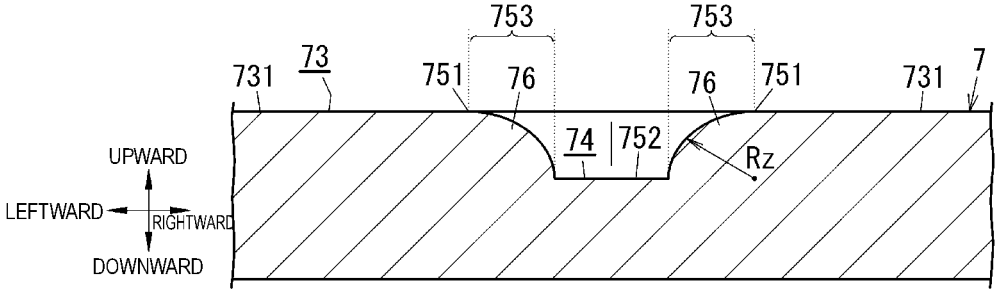
FIG. 13C is a schematic cross-sectional view of the corners of the push switch according to the exemplary embodiment of the present disclosure taken along line X1-X1 in FIG. 13B. The corners each have the second shape.

In an example illustrated in FIGS. 12A to 12C, a first shape is used as a shape for corners 76 at a point of intersection between first groove 741 and second groove 742. In an example illustrated in FIGS. 13A to 13C, a second shape is used as a shape for corners 76 at a point of intersection between first groove 741 and second groove 742. A difference between the first shape and the second shape is a relation between radius-of-curvature-in-a-plan-view Rxy that is a radius of curvature of corner 76, in a top view (see FIG. 12B) and radius-of-curvature-in-a-cross-sectional-view Rz that is a radius of curvature of corner 76, in a cross-sectional view (see FIG. 12C). In the present disclosure, radius-of-curvature-in-a-plan-view Rxy is a radius of curvature of corner 76, in a plane that is along contact surface 73. In an example in FIG. 12B, radius-of-curvature-in-a-plan-view Rxy is a radius of curvature of corner 76, in a plane of bottom 752 of grooves 74. In the present disclosure, radius-of-curvature-in-a-cross-sectional-view Rz is a radius of curvature of corner 76, in a plane that is perpendicular to contact surface 73. In an example in FIG. 12C, radius-of-curvature-in-a-cross-sectional-view Rz is a radius of curvature of corner 76, in a cross-sectional view taken along line X1-X1 in FIG. 12B.

A difference in a shape of each of corners 76 varies a stress that acts on movable contact 8 when movable contact 8 is pushed against stationary contact 7. A stress that acts on movable contact 8 in a case where radius-of-curvature-in-a-plan-view Rxy is larger than radius-of-curvature-in-a-cross-sectional-view Rz is especially smaller than a stress that acts on movable contact 8 in a case where radius-of-curvature-in-a-plan-view Rxy is smaller than radius-of-curvature-in-a-cross-sectional-view Rz. In the first shape illustrated in FIGS. 12A to 12C, radius-of-curvature-in-a-plan-view Rxy is larger than radius-of-curvature-in-a-cross-sectional-view Rz. Therefore, a relational expression "Rxy>Rz" is satisfied. On the other hand, in the second shape illustrated in FIGS. 13A to 13C, radius-of-curvature-in-a-plan-view Rxy is smaller than radius-of-curvature-in-a-cross-sectional-view Rz. Therefore, a relational expression "Rxy<Rz" is satisfied. That is to say, preferably, radius-of-curvature-in-a-plan-view Rxy is larger than radius-of-curvature-in-a-cross-sectional-view Rz, as in the first shape, to reduce a stress that acts on movable contact 8 when movable contact 8 is pushed against stationary contact 7.

Figure 14A:
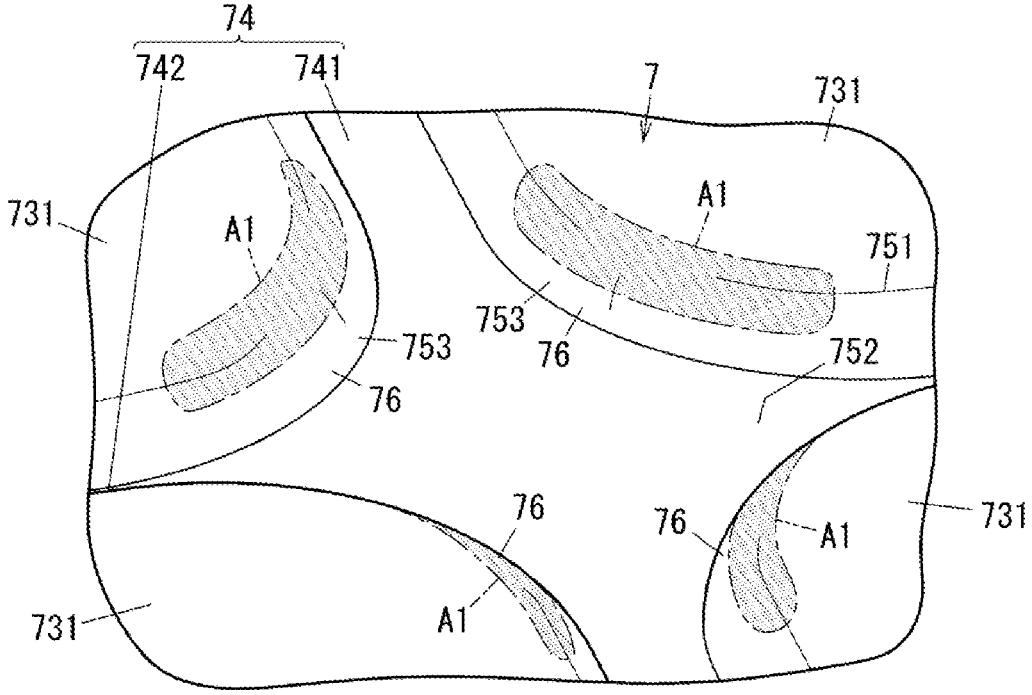
FIG. 14A is an enlarged perspective view of an important part that illustrates corners of the push switch according to the exemplary embodiment of the present disclosure. The corners each have the first shape.
Figure 14B:
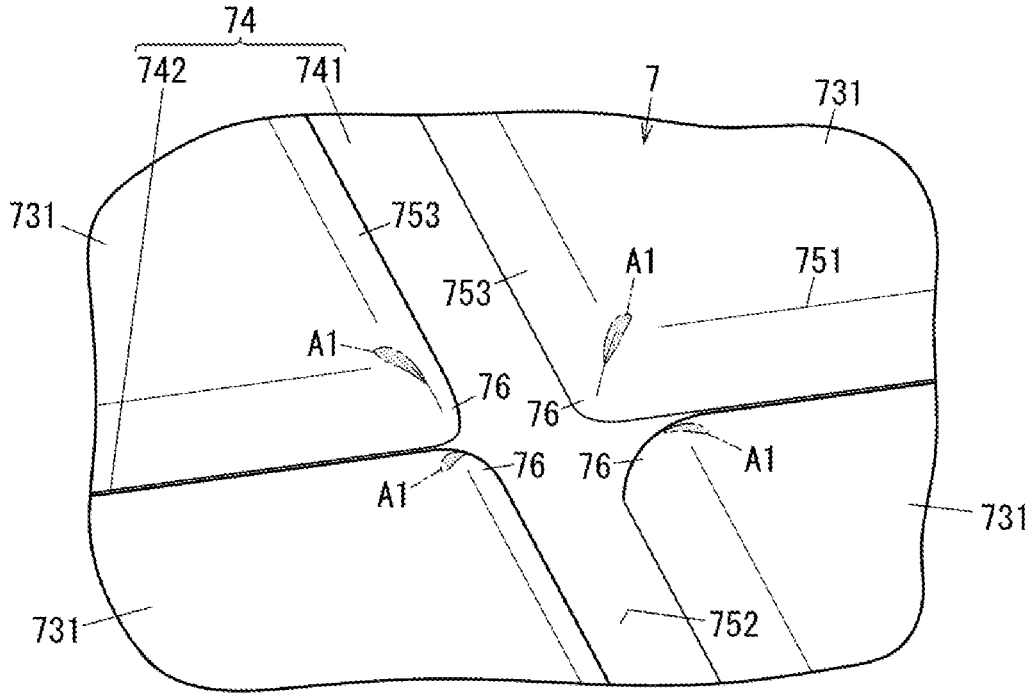
FIG. 14B is an enlarged perspective view of an important part that illustrates corners of the push switch according to the exemplary embodiment of the present disclosure. The corners each have the second shape.

FIG. 14A is a schematic view that illustrates contact areas A1 at corners 76 that each have the first shape. Contact areas A1 are areas of stationary contact 7. Movable contact 8 comes into contact with contact areas A1 when movable contact 8 is pushed against stationary contact 7. FIG. 14B is a schematic view that illustrates contact areas A1 at corners 76 that each have the second shape. Contact areas A1 are areas of stationary contact 7. Movable contact 8 comes into contact with contact areas A1 when movable contact 8 is pushed against stationary contact 7. As clearly illustrated in FIGS. 14A and 14B, a shape and an area of each of contact areas A1 with which movable contact 8 comes into contact vary due to a shape of each of corners 76 at a point of intersection between first groove 741 and second groove 742. For example, in the first shape illustrated in FIG. 14A, each of contact areas A1 is a "laterally long" area that extends along opening edge 751 of corresponding one of grooves 74, in a plane that is along contact surface 73. On the other hand, in the second shape illustrated in FIG. 14B, each of contact areas A1 is a "vertically long" area that extends perpendicularly to opening edge 751 of corresponding one of grooves 74. Each of contact areas A1 of the first shape is larger than each of contact areas A1 of the second shape. Consequently, the first shape that satisfies the relational expression "Rxy>Rz" reduces occurrences of a stress concentration at movable contact 8, compared with the second shape that satisfies the relational expression "Rxy<Rz". Therefore, the first shape reduces a stress that acts on movable contact 8.

Figure 15:
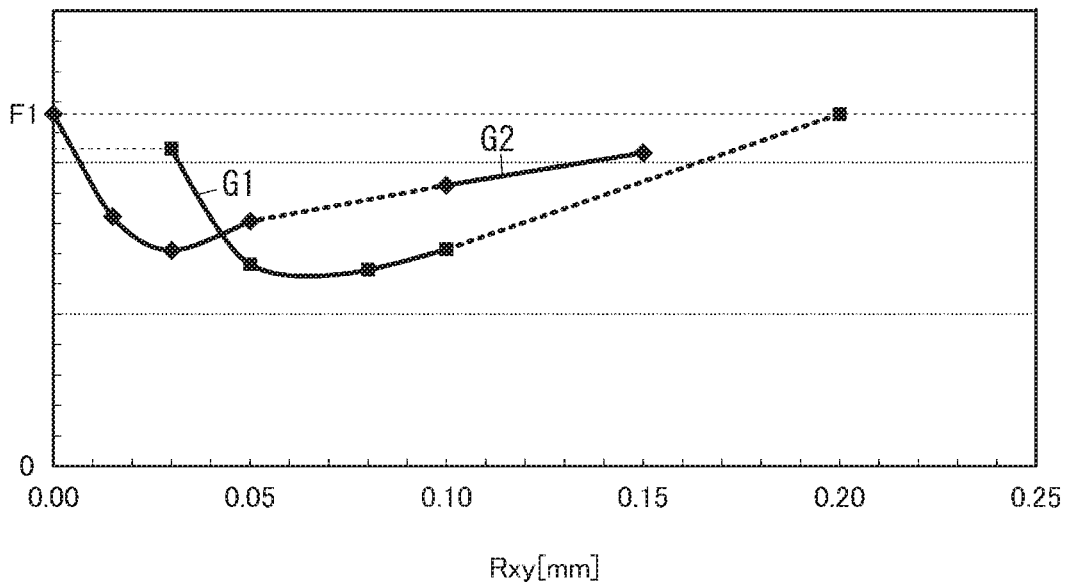
FIG. 15 is a graph that illustrates a relation between a shape of each of corners and magnitude of a stress that acts on a movable contact, in the push switch according to the exemplary embodiment of the present disclosure.

FIG. 15 is a graph that illustrates a relation between a shape of each of corners 76 and magnitude of a stress that acts on movable contact 8 when movable contact 8 is pushed against stationary contact 7. In FIG. 15, a horizontal axis represents a length of radius-of-curvature-in-a-plan-view Rxy, and a vertical axis represents a stress that acts on movable contact 8 (a maximum von Mises stress). Further, in FIG. 15, "G1" is assigned to a line that represents a case in which radius-of-curvature-in-a-cross-sectional-view Rz is "0.03 mm". Further, in FIG. 15, "G2" is assigned to a line of a comparative example that represents a case in which radius-of-curvature-in-a-cross-sectional-view Rz is "0.00 mm" Suppose that, in either case, magnitude of a load that pushes movable contact 8 against stationary contact 7 is "13 N", and a width of each of grooves 74 (a distance between opening edges 751 of first groove 741, or a distance between opening edges 751 of second groove 742) is "0.09 mm".

Criterion value F1 is a stress in a case where radius-of-curvature-in-a-cross-sectional-view Rz is "0.00 mm", and radius-of-curvature-in-a-plan-view Rxy is "0.00 mm" (a point on line G2 at which a value represented by the horizontal axis is "0.00"). That is to say, criterion value F1 is a stress in a case where corners 76 are not curved surfaces. As clearly represented by graph G1 in FIG. 15, it is expected that a stress is smaller than criterion value F1 if radius-of-curvature-in-a-cross-sectional-view Rz is "0.03 mm" and radius-of-curvature-in-a-plan-view Rxy is larger than radius-of-curvature-in-a-cross-sectional-view Rz (Rxy>Rz). In an example in FIG. 15, a stress that is substantially equal to criterion value F1 acts on movable contact 8 when radius-of-curvature-in-a-cross-sectional-view Rz is "0.03 mm" and radius-of-curvature-in-a-plan-view Rxy is substantially equal to an upper limit of "0.2 mm" that has been determined. Therefore, if, in the example, radius-of-curvature-in-a-cross-sectional-view Rz is "0.03 mm", a stress is smaller than criterion value F1, in a range of radius-of-curvature-in-a-plan-view Rxy that is 0.03 mm<Rxy<0.2 mm (the upper limit). A shape of each of corners 76 is adjusted within the range. Consequently, a stress becomes smaller than criterion value F1 by at most approximately 40%.

If radius-of-curvature-in-a-plan-view Rxy is equal to radius-of-curvature-in-a-cross-sectional-view Rz (Rxy=Rz), a stress hardly becomes smaller than criterion value F1. A conceivable reason that a stress hardly becomes smaller than criterion value F1 is, for example, that a surface of each of corners 76 becomes part of a surface of a sphere. Consequently, areas of movable contact 8 that are in contact with corners 76, respectively, are almost points. Further, if radius-of-curvature-in-a-plan-view Rxy is larger than or equal to the upper limit ("0.2 mm" in the example in FIG. 15), a stress hardly become smaller than criterion value F1. A conceivable reason that a stress hardly becomes smaller than criterion value F1 is, for example, that a distance between a pair of corners 76 that are opposite each other is excessive. That is to say, if a distance between a pair of corners 76 that are opposite each other is excessive, movable contact 8 is more likely to be bent between the pair of corners 76. Therefore, a larger moment about one of the pair of corners 76 acts on movable contact 8. Consequently, corners 76 apply a larger stress to movable contact 8. Therefore, the stress hardly becomes smaller than criterion value F1.

As described above, magnitude of a stress that acts on movable contact 8 is adjusted for push switch 1 according to the present exemplary embodiment. The stress acts on movable contact 8 when movable contact 8 is pushed against stationary contact 7. The magnitude of a stress that acts on movable contact 8 is adjusted by a shape of corners 76 of stationary contact 7. Especially when radius-of-curvature-in-a-plan-view Rxy is larger than radius-of-curvature-in-a-cross-sectional-view Rz, a stress that acts on movable contact 8 is small. However, above radius-of-curvature-in-a-plan-view Rxy, above radius-of-curvature-in-a-cross-sectional-view Rz, and above dimensions, such as a width, of grooves 74 are only examples and may be appropriately changed. Radius-of-curvature-in-a-cross-sectional-view Rz is not limited to "0.03 mm", but may be "0.05 mm", for example. A configuration that reduces a stress that acts on movable contact 8 has been described above. The configuration reduces a stress that acts on conductive layer 72 of stationary contact 7. Consequently, electrical properties of push switch 1 are less likely to vary. Conductive layer 72 is a plated layer, for example.

(2.6) Direction of Rolling

Figure 16:
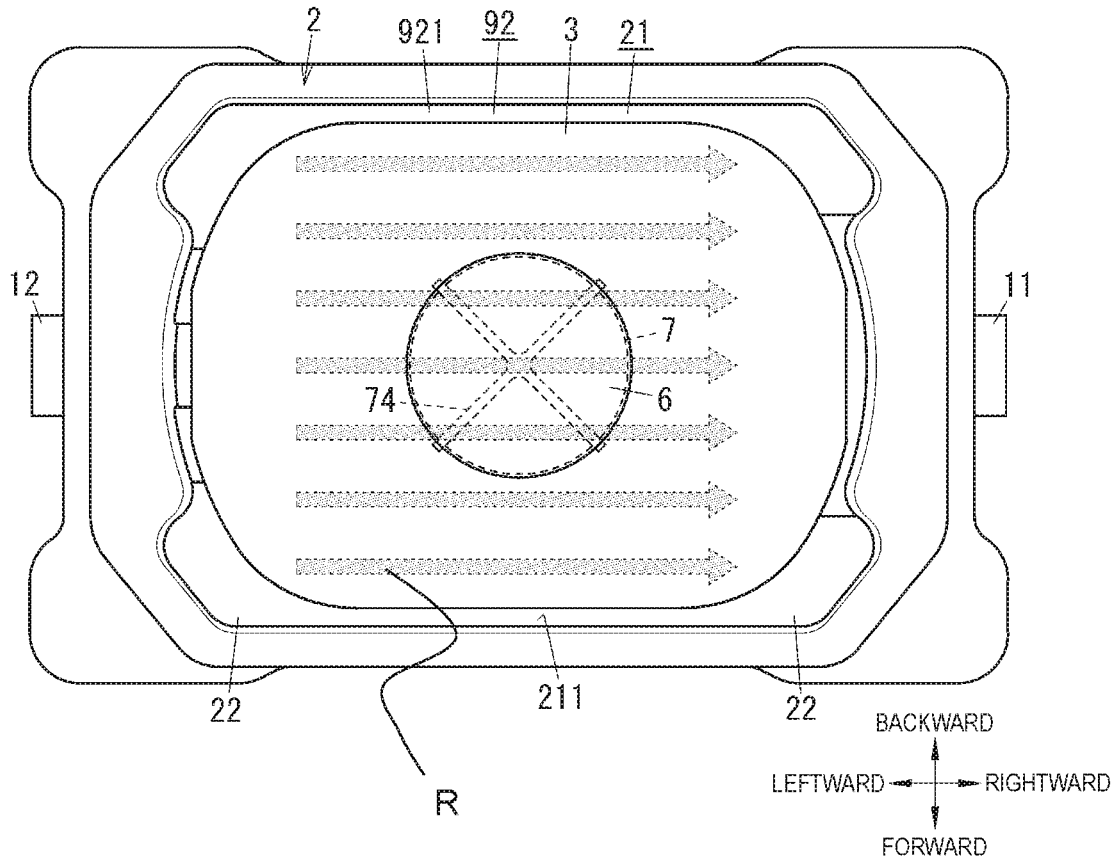
FIG. 16 is a plan view of the push switch according to the exemplary embodiment of the present disclosure.

In push switch 1 according to the present exemplary embodiment, a direction of rolling of movable component 3 intersects with directions in which grooves 74 (first groove 741 and second groove 742) extend, as illustrated in FIG. 16. In FIG. 16, arrows that point right schematically represent a direction of rolling R of movable component 3.

In the present disclosure, the "direction of rolling" is a direction in which a metal sheet that will become movable component 3 is rolled at a time of a manufacturing process. That is to say, if a process for manufacturing a metal sheet that becomes movable component 3 includes a step that rolls a metal sheet, a direction in which the metal sheet is rolled in the step is the direction of rolling. If a bending line is generated in a metal sheet and the bending line is along a direction of rolling R, durability of the metal sheet deteriorates, compared with a case in which a bending line is generated in a metal sheet and a direction of the bending line intersects with the direction of rolling.

In the present exemplary embodiment, first groove 741 is a straight groove that extends forward right diagonally, in a top view. Further, second groove 742 is a straight groove that extends backward right diagonally, in a top view, as described above. A direction of rolling R of movable component 3 is lateral. Therefore, the direction of rolling of movable component 3 intersects with both a direction in which first groove 741 extends and a direction in which second groove 742 extends.

The above configuration improves durability of movable component 3. That is to say, when movable contact 8 is pushed against stationary contact 7, opening edges 751 of grooves 74 (first groove 741 and second groove 742) apply reaction force to movable component 3. The reaction force generates a bending line in movable component 3. However, the bending line intersects with a direction of rolling R of movable component 3. Consequently, durability of movable component 3 is improved, compared with a case in which a bending line is generated in movable component 3 and the bending line is parallel to a direction of rolling R of movable component 3.

(2.7) Other Examples of Stationary Contact

Figure 17A:
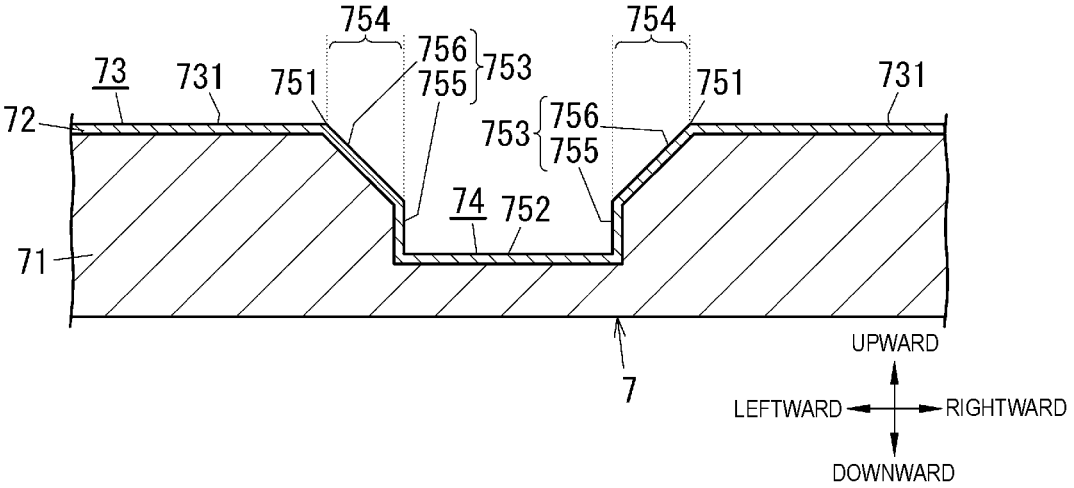
FIG. 17A is a schematic cross-sectional view of an aspect of a stationary contact of the push switch according to the exemplary embodiment of the present disclosure.
Figure 17B:
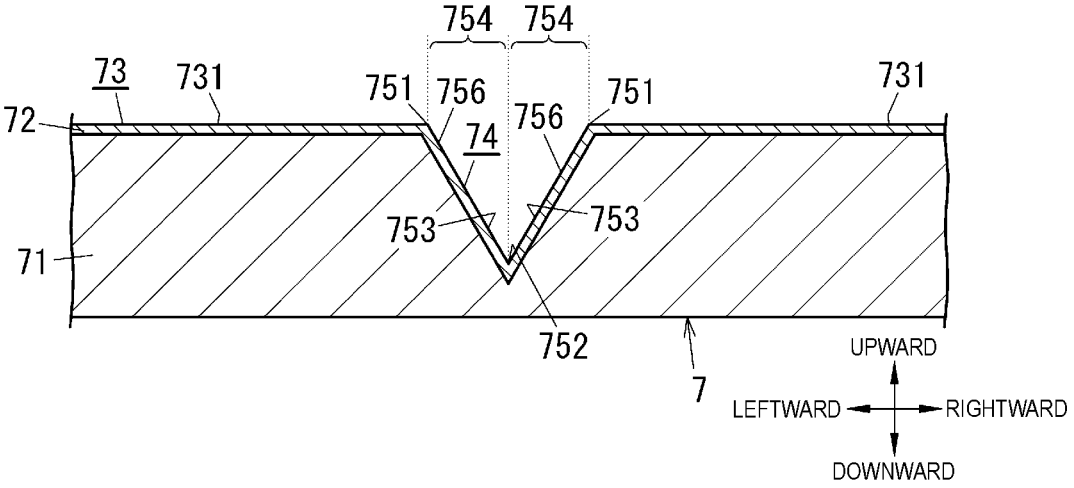
FIG. 17B is a schematic cross-sectional view of an aspect of the stationary contact of the push switch according to the exemplary embodiment of the present disclosure.
Figure 17C:
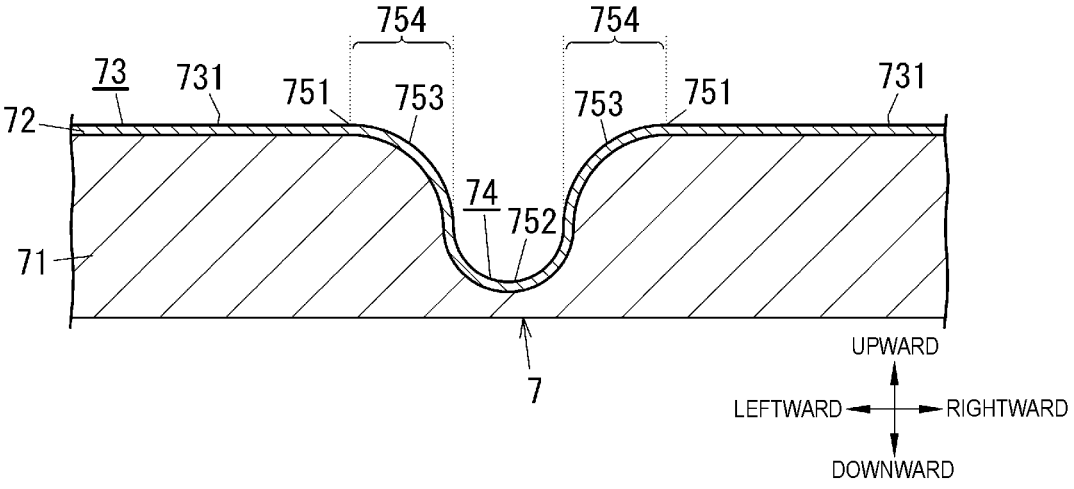
FIG. 17C is a schematic cross-sectional view of an aspect of the stationary contact of the push switch according to the exemplary embodiment of the present disclosure.
Figure 18A:
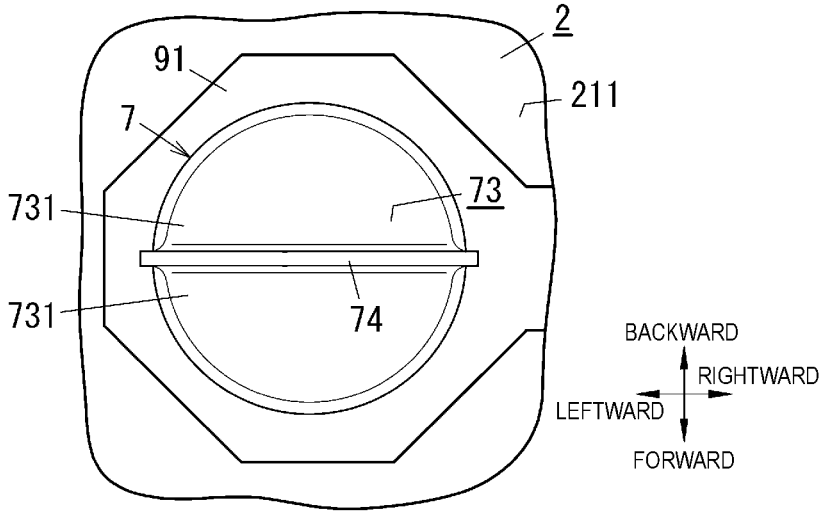
FIG. 18A is a plan view of an important part that illustrates an aspect of a stationary contact of the push switch according to the exemplary embodiment of the present disclosure.
Figure 18B:
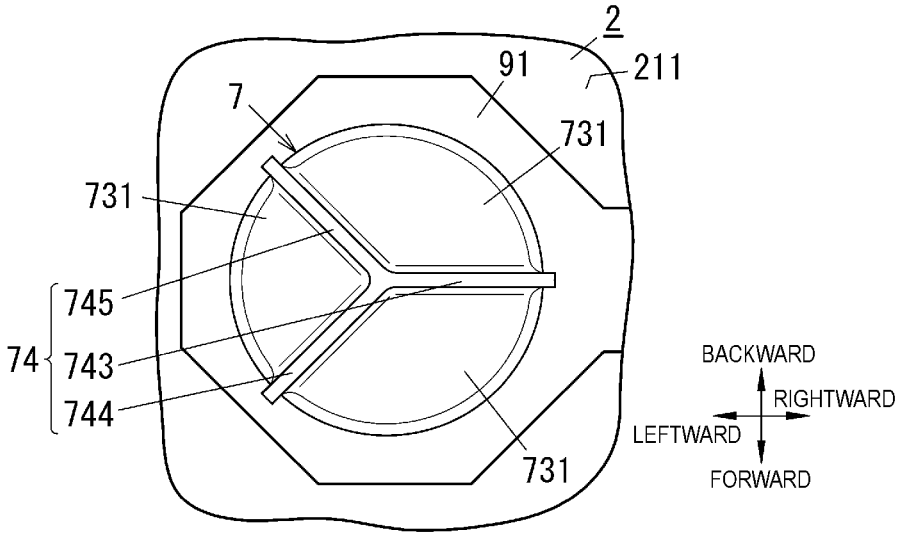
FIG. 18B is a plan view of an important part that illustrates an aspect of a stationary contact of the push switch according to the exemplary embodiment of the present disclosure.
Figure 18C:
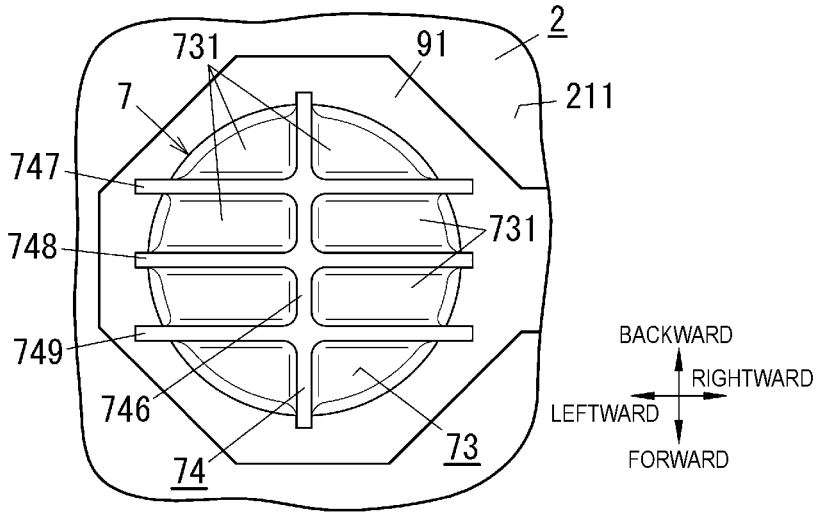
FIG. 18C is a plan view of an important part that illustrates an aspect of a stationary contact of the push switch according to the exemplary embodiment of the present disclosure.

Push switch 1 may include stationary contact 7 configured as exemplified in FIGS. 17A to 18C. FIGS. 17A to 17C are enlarged views of an important part that corresponds to area Z1 in FIG. 10A. FIGS. 17A to 17C are cross-sectional views that each schematically illustrate only stationary contact 7. Therefore, various dimensional relations (e.g., a thickness of base material 71 and a thickness of conductive layer 72) in FIGS. 17A to 17C are different from actual dimensional relations. Further, FIGS. 18A to 18C are enlarged views of an important part that corresponds to area Z2 in FIG. 3A.

In an example illustrated in FIG. 17A, slopes 754 of connection surfaces 753 are planes. More specifically, each of connection surfaces 753 has inner side surface 755 and tapered surface 756. Inner side surface 755 is a plane that extends upward from each of ends of a width of bottom 752 of each of grooves 74. Inner side surface 755 is perpendicular to contact surface 73. Tapered surface 756 is an inclined plane. Consequently, the closer to a top of each of grooves 74 (an opening surface), the larger a width of each of grooves 74. Consequently, whole tapered surface 756 of each of connection surfaces 753 is inclined at an acute angle relative to contact surface 73. Therefore, whole tapered surface 756 is slope 754.

Further, in an example illustrated in FIG. 17B, slopes 754 of connection surfaces 753 are planes, similarly as in FIG. 17A. More specifically, each of connection surfaces 753 has tapered surface 756. Tapered surface 756 is a plane that extends upward diagonally from bottom 752 of each of grooves 74. Further, tapered surface 756 is inclined. Consequently, the closer to a top of each of grooves 74 (an opening surface), the larger a width of each of grooves 74. Consequently, whole tapered surface 756 of each of connection surfaces 753 is inclined at an acute angle relative to contact surface 73. Therefore, whole tapered surface 756 is slope 754.

Further, in an example illustrated in FIG. 17C, slopes 754 are surfaces curved in such a manner that a width of bottom 752 of each of grooves 74 becomes narrower toward a lowest portion of bottom 752. Consequently, a substantially whole inner surface of each of grooves 74 is a curved surface.

In an example illustrated in FIG. 18A, groove 74 is one straight groove. More specifically, groove 74 is straight and laterally extends through substantially a center of contact surface 73. Groove 74 divides contact surface 73 into two areas 731.

In an example illustrated in FIG. 18B, grooves 74 include three grooves 743, 744, 745. Three grooves 743, 744, 745 extend in different directions in a plane that is along contact surface 73. Three grooves 743, 744, 745 are straight and extend radially from substantially a center of contact surface 73. Two grooves of three grooves 743, 744, 745 correspond to the "first groove" and the "second groove". Grooves 74 divide contact surface 73 into three areas 731.

In an example illustrated in FIG. 18C, grooves 74 include four grooves 746, 747, 748, 749. Groove 746 is straight and vertically extends through substantially a center of contact surface 73. Three grooves 747, 748, 749 are each straight and laterally extend. Three grooves 747, 748, 749 are vertically arranged at regular intervals. Therefore, three grooves 747, 748, 749 are each substantially perpendicular to groove 746. Groove 746 and one of three grooves 747, 748, 749 correspond to the "first groove" and the "second groove". Grooves 74 divide contact surface 73 into eight areas 731.

(3) Examples of Modifications

The above present exemplary embodiment is merely one of various exemplary embodiments of the present disclosure. The exemplary embodiment is variously modified according to design as long as an object of the present disclosure is fulfilled. Hereinafter, some examples of modifications of the exemplary embodiment will be recited. Some or all of the examples of modifications described later are appropriately combined and applied.

A shape of an opening of depression 21 of push switch 1 is not only like an ellipse whose lateral length is longer than a vertical length of the ellipse, in a top view, but also may be like a rectangle, a circle, or a polygon. In case of the configuration, shapes of movable component 3 and other components are determined according to a shape of an opening of depression 21.

Figure 19A:
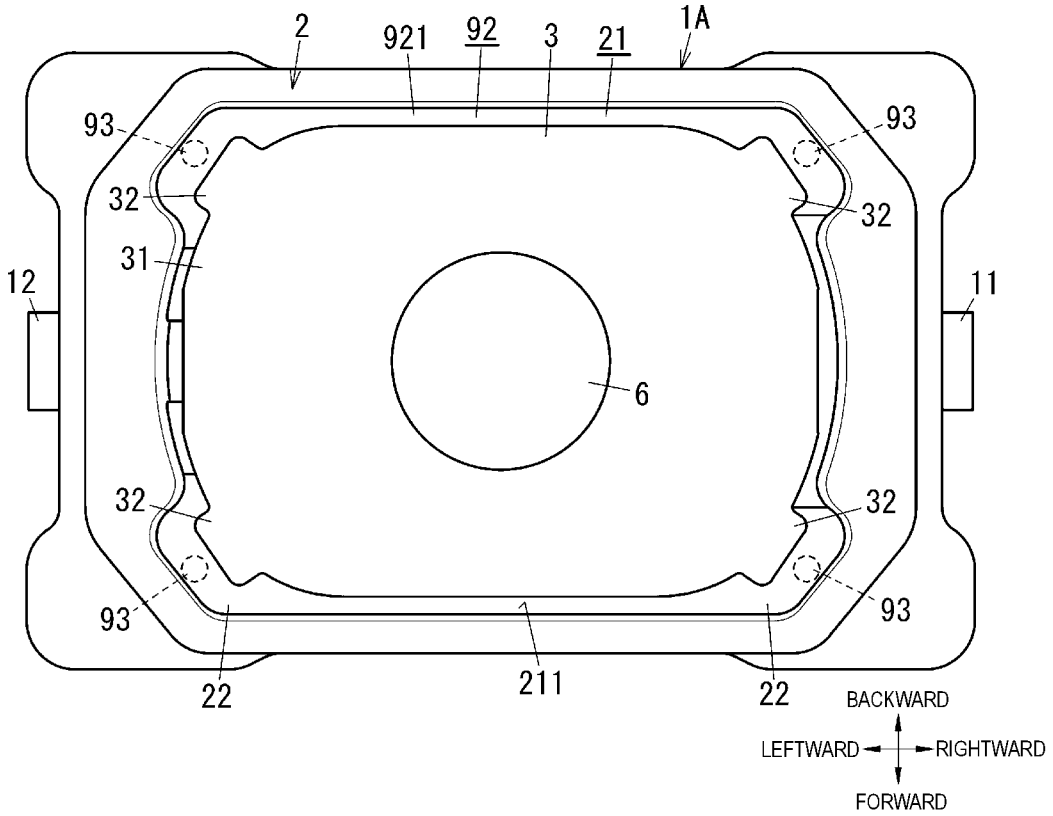
FIG. 19A is a plan view of a push switch according to a first example of modifications of the exemplary embodiment of the present disclosure.

FIG. 19A illustrates push switch 1A according to a first example of modifications of the exemplary embodiment. In push switch 1A according to the first example of modifications, movable component 3 has main body 31 and a plurality of (four in the first example of modifications) legs 32. Main body 31 has a shape like an ellipse whose lateral length is longer than a vertical length of the ellipse, in a top view, similarly as movable component 3 in the above exemplary embodiment. Four legs 32 protrude from a periphery of main body 31. Four legs 32 are arranged at predetermined intervals along the periphery of main body 31. Four legs 32 are each substantially rectangular. Four legs 32 are connected with main body 31. Movable component 3 is disposed in depression 21. An orientation of each of the plurality of legs 32 corresponds to corresponding one of a plurality of enlarging depressions 22. In the configuration of the first example of modifications, four legs 32 protrude from main body 31. Therefore, four legs 32 increase a distance from movable contact 8 to stationary contact 7. Therefore, a length of a stroke becomes longer.

Figure 19B:
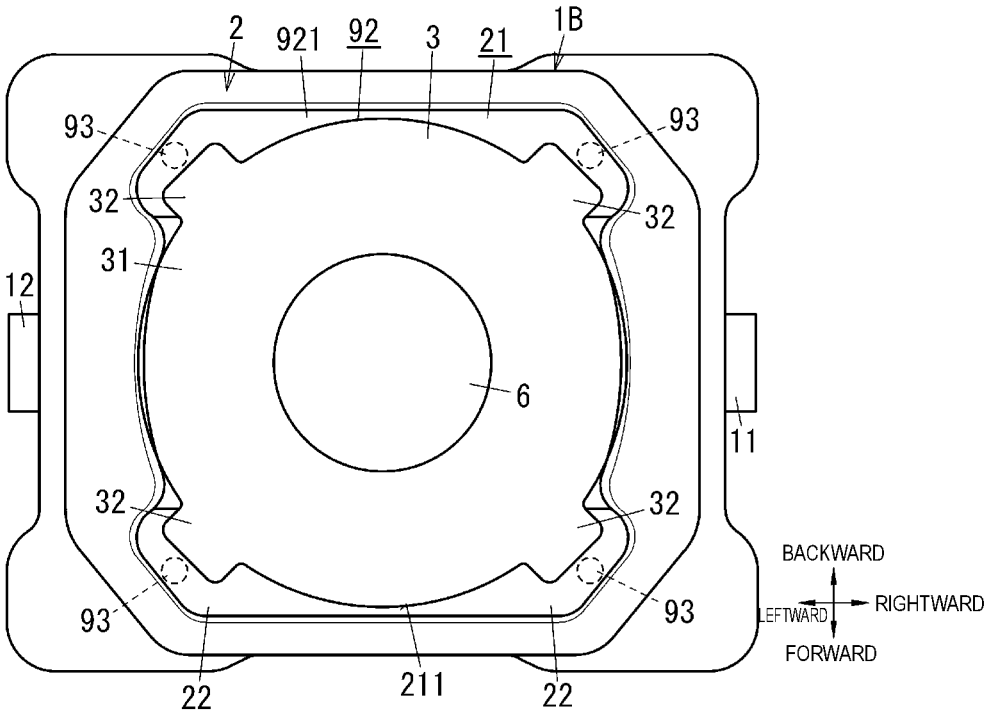
FIG. 19B is a plan view of a push switch according to a second example of modifications of the exemplary embodiment of the present disclosure.

FIG. 19B illustrates push switch 1B according to a second example of modifications of the exemplary embodiment. In push switch 1B according to the second example of modifications, movable component 3 has main body 31 and a plurality of (four in the second example of modifications) legs 32, similarly as the first example of modifications. In the second example of modifications, main body 31 is substantially circular, in a top view.

As another example of modifications, a length of a stroke of push switch 1 may be appropriately changed. The length of a stroke of push switch 1 is an amount of movement of protective sheet 5 through an operational area at a time when push switch 1 is pushed to close push switch 1. The length of a stroke of push switch 1 may be relatively short, medium, or relatively long, for example. The medium length is between the relatively short length and the relatively long length. Further, push switch 1 may include first contacts and second contacts, instead of contacts 4. In case of push switch 1 that includes the first contacts and the second contacts, when protective sheet 5 is pushed, the first contacts are closed first. If protective sheet 5 is further pushed while the first contacts are closed, the second contacts are closed. In case of push switch 1 that includes the first contacts and the second contacts, movable component 3 may include two metal sheets that are buckled by different operational force. Further, push switch 1 is not necessarily normally open. Push switch 1 may be normally closed. Push switch 1 that is normally closed is opened when push switch 1 is operated.

Further, push switch 1 is not only used as one of controls of a device operated by a person, but also may be used as a detector for a device. If push switch 1 is used as a detector for a device, push switch 1 is used, for example, as a limit switch to detect a position of a component of a machine, such as an actuator.

Further, movable component 3 does not necessarily include a plurality of leaf springs 30 stacked together. Movable component 3 may include one leaf spring. Further, movable component 3 does not necessarily include three leaf springs 30. Movable component 3 may include two leaf springs 30, or four or more leaf springs 30. In that case, a number of leaf springs 30 stacked together varies operational force required to buckle movable component 3. Consequently, the number of leaf springs 30 stacked together varies tactility of push switch 1.

Pressing component 6 is not necessarily disposed between protective sheet 5 and pressure receiving portion 33. Pressing component 6 may be disposed on a top surface of protective sheet 5, for example. In that case, an underside of pressing component 6 may be joined to a top surface of protective sheet 5. In the configuration, protective sheet 5 transfers operational force that acts on pressing component 6 to pressure receiving portion 33.

Further, protective sheet 5 only needs to cover at least part of depression 21. Protective sheet 5 that covers whole depression 21 is not essential to push switch 1. For example, a hole may be made through part of protective sheet 5. Push switch 1 may not include protective sheet 5.

Further, a conductive film is not necessarily made on a whole underside of movable component 3. For example, a conductive film may be made on part of an underside of movable component 3 with which stationary contact 7 is in contact, and on part of the underside of movable component 3 with which stationary contact 921 is in contact. Further, a conductive film may not be appropriately made on an underside of movable component 3. In that case, preferably, part or all of movable component 3 is made of a conductive material. Consequently, movable component 3 is surely conductive.

Retaining pins Y1 retain one of metal components 9 when case 2 is molded. Retaining pins Y1 are not necessarily in contact with an underside of the one of metal components 9 (stationary contact 921). Retaining pins Y1 may be in contact with a top surface of the one of metal components 9. In that case, pin receiving portions 93 are on the top surface of the one of metal components 9. Further, even if retaining pins Y1 are in contact with an underside of the one of metal components 9, pin holes 24 made through an underside of case 2 may be filled with a synthetic resin after case 2 has been molded.

Conductive layer 72 is not limited to a plated layer. Conductive layer 72 may be a painted film or a film, for example. If conductive layer 72 is a film, conductive layer 72 is stuck to base material 71.

Grooves 74 of stationary contact 7 are not necessarily complete hollows. A synthetic resin of which case 2 is made may exist in grooves 74 of stationary contact 7. That is to say, a synthetic resin may fill at least part of grooves 74 of stationary contact 7.

(4) Conclusion

As described above, a first aspect of push switch (1, 1A, 1B) includes stationary contact (7) and movable contact (8). Stationary contact (7) includes base material (71) and conductive layer (72) that covers base material (71). Movable contact (8) is disposed opposite contact surface (73) of stationary contact (7). Movable contact 8 moves between a first position (closed position) where movable contact (8) is in contact with contact surface (73) and a second position (open position) where movable contact (8) is apart from contact surface (73). Stationary contact (7) has groove (74) that divides contact surface (73) into a plurality of areas (731). Connection surfaces (753) connect respective opening edges (751) of groove (74) with bottom (752) of groove (74). Each of connection surfaces (753) has slope (754). Slope (754) is inclined at acute angle (θ) relative to contact surface (73).

According to the first aspect, groove (74) divides contact surface (73) into the plurality of areas (731). Therefore, a structure-for-contact-at-a-plurality-of-positions is made. The structure-for-contact-at-a-plurality-of-positions allows movable contact (8) to be in contact with a plurality of positions of stationary contact (7). Therefore, even if foreign matter enters between stationary contact (7) and movable contact (8), electrical properties of push switch (1) are less likely to deteriorate, compared with a case in which contact surface (73) of stationary contact (7) is one flat plane. Further, connection surfaces (753) connect respective opening edges (751) of groove (74) with bottom (752) of groove (74). Each of connection surfaces (753) has slope (754). Slope (754) is inclined at acute angle (θ) relative to contact surface (73). Therefore, conductive layer (72) is less likely to be damaged at opening edges (751) of groove (74). Further, a stress concentration is less likely to occur at opening edges (751) of groove (74) when movable contact (8) is pushed against stationary contact (7). Consequently, conductive layer (72) is less likely to be removed, and thus electrical properties of push switch 1 are less likely to vary though push switch 1 has the structure-for-contact-at-a-plurality-of-positions.

A second aspect of push switch (1, 1A, 1B) is the first aspect in which slope (754) is a curved surface.

The second aspect allows a step to be less likely to be generated at opening edges (751) of groove (74). Therefore, conductive layer (72) is much less likely to be removed.

A third aspect of push switch (1, 1A, 1B) is the first aspect in which slope (754) is a plane.

The third aspect simplifies a shape of groove (74).

In a fourth aspect of push switch (1, 1A, 1B), groove (74) includes first groove (741) and second groove (742) that extend in different directions in a plane that is along contact surface (73). Each of connection surfaces (753) has slope (754) at least at each of corners at a point of intersection between first groove (741) and second groove (742).

The fourth aspect allows conductive layer (72) to be less likely to be damaged at the point of intersection between first groove (741) and second groove (742). Further, the fourth aspect allows a stress concentration to be less likely to occur when movable contact (8) is pushed against stationary contact (7). Therefore, conductive layer (72) is less likely to be removed at the point of intersection between first groove (741) and second groove (742).

In a fifth aspect of push switch (1, 1A, 1B), at each of corners (76), each of connection surfaces (753) is a curved surface that is curved in such a manner that the curved surface protrudes toward an inside of groove (74), at least in a plane that is along contact surface (73).

The fifth aspect allows a stress concentration to be less likely to occur when movable contact (8) is pushed against stationary contact (7).

In a sixth aspect of push switch (1, 1A, 1B), radius of curvature (Rxy) of each of corners (76) in a plane that is along contact surface (73) is smaller than a predetermined upper limit.

The sixth aspect allows a stress concentration to be less likely to occur when movable contact (8) is pushed against stationary contact (7).

In a seventh aspect of push switch (1, 1A, 1B), radius of curvature (Rxy) of each of corners (76) in a plane that is along contact surface (73) is larger than radius of curvature (Rz) of each of corners (76) in a plane that is perpendicular to contact surface (73).

The seventh aspect allows a stress concentration to be less likely to occur when movable contact (8) is pushed against stationary contact (7).

In an eighth aspect of push switch (1, 1A, 1B), conductive layer (72) is a plated layer.

The eighth aspect allows a thickness of conductive layer (72) is to be easily adjusted.

In a ninth aspect of push switch (1, 1A, 1B), stationary contact (7) has protrusion (70) that protrudes from a base surface. Contact surface (73) is a surface of an end of protrusion (70).

The ninth aspect suppresses movable contact (8) from being in contact with a portion other than contact surface (73).

A tenth aspect of push switch (1, 1A, 1B) is any one of the first to ninth aspects in which conductive layer (72) includes first conductive layer (721) on contact surface (73), and second conductive layer (722) on each of connection surfaces (753), first conductive layer (721) being connected with second conductive layers (722).

The tenth aspect allows conductive layer (72) to be less likely to be removed at a boundary between first conductive layer (721) and second conductive layer (722).

An eleventh aspect of push switch (1, 1A, 1B) is any one of the first to tenth aspects that further includes movable component (3) that has movable contact (8) on a surface of movable component (3). The surface of movable component (3) is opposite stationary contact (7). A direction of rolling R of movable component (3) intersects with a direction in which groove (74) extends.

The eleventh aspect improves durability of movable component (3), compared with a case in which the direction of rolling of movable component (3) is parallel to a direction in which groove (74) extends.

Configurations of the second to eleventh aspects are not essential to push switch (1, 1A, 1B). Therefore, push switch (1, 1A, 1B) may not appropriately include the configurations of the second to eleventh aspects.

REFERENCE MARKS IN THE DRAWINGS

1, 1A, 1B: push switch
2: case
3: movable component
4: contacts
5: protective sheet
6: pressing component
7: stationary contact
8: movable contact
9: metal component
11, 12: terminal
21: depression
22: enlarging depression
23: top surface
24: pin hole
25A, 25B: wall
31: main body
32: leg
33: pressure receiving portion
51: joined-portion
70: protrusion
71: base material
72: conductive layer
73: contact surface

74: groove
76: corner
91: metal component
92: metal component
93: pin receiving portion
100, 101: metal sheet
211: bottom surface
212: contact portion
213*a*, 213*b*: side surface
221: bottom surface
222: side surface
721, 722: conductive layer
731: area
741, 742, 743, 746, 747, 748, 749: groove
751: opening edge
752: bottom
753: connection surface
754: slope
755: inner side surface
756: tapered surface
921: stationary contact
D1: depth
D2: depth
L1: imaginary line
L2: imaginary line
P1: powder
Y1: retaining pin
Y2: punch
Y3: pad
Y4: punch
Y5: die
Z1: area
Z2: area
θ: angle of inclination
Rxy: radius-of-curvature-in-a-plan-view
Rz: radius-of-curvature-in-a-cross-sectional-view

The invention claimed is:

1. A push switch comprising:

a stationary contact that includes a base material and a conductive layer that covers the base material; and a movable component that has a movable contact on a surface of the movable component, the surface of the movable component being opposite the stationary contact, the movable contact being disposed opposite a contact surface of the stationary contact, the movable contact being movable between a first position where the movable contact is in contact with the contact surface and a second position where the movable contact is apart from the contact surface, wherein:

the stationary contact has a groove that divides the contact surface into a plurality of areas, connection surfaces connect respective opening edges of the groove with a bottom of the groove, and each of the connection surfaces has a slope that is inclined at an acute angle relative to the contact surface, and a direction of rolling of the movable component intersects with a direction in which the groove extends, the direction of rolling being a direction in which a metal sheet, from which the movable component is formed, is rolled at a time of a manufacturing process of the metal sheet.

2. The push switch according to claim 1, wherein the slope is a curved surface.

3. The push switch according to claim 1, wherein the slope is a plane.

4. The push switch according to claim 1, wherein the groove includes a first groove and a second groove that extend in different directions in a plane that is along the contact surface, and each of the connection surfaces has the slope at least at each of corners at a point of intersection between the first groove and the second groove.

5. The push switch according to claim 3, wherein the groove includes a first groove and a second groove that extend in different directions in a plane that is along the contact surface, and each of the connection surfaces has the slope at least at each of corners at a point of intersection between the first groove and the second groove.

6. The push switch according to claim 4, wherein at each of the corners, each of the connection surfaces is a curved surface that is curved in such a manner that the curved surface protrudes toward an inside of the groove, at least in the plane that is along the contact surface.

7. The push switch according to claim 6, wherein a radius of curvature of each of the corners in the plane that is along the contact surface is smaller than a predetermined upper limit.

8. The push switch according to claim 6, wherein a radius of curvature of each of the corners in the plane that is along the contact surface is larger than a radius of curvature of each of the corners in a plane that is perpendicular to the contact surface.

9. The push switch according to claim 1, wherein the conductive layer is a plated layer.

10. The push switch according to claim 1, wherein the stationary contact has a protrusion that protrudes from a base surface, and the contact surface is a surface of an end of the protrusion.

11. The push switch according to claim 1, wherein the conductive layer includes a first conductive layer on the contact surface, and a second conductive layer on each of the connection surfaces, the first conductive layer being connected with the second conductive layer.

12. The push switch according to claim 1, wherein the groove includes a first groove and a second groove that extend in different directions in a plane that is along the contact surface, the first groove extend in a first direction, the second extend in a second direction, and the direction of rolling of the movable component intersects with the first direction and the second direction.

13. The push switch according to claim 12, wherein the first direction is orthogonal to the second direction.

14. A push switch comprising:

a stationary contact that includes a base material and a conductive layer that covers the base material; and a movable component that has a movable contact on a surface of the movable component, the surface of the movable component being opposite the stationary contact, the movable contact being disposed opposite a contact surface of the stationary contact, the movable contact being movable between a first position where the movable contact is in contact with the contact surface and a second position where the movable contact is apart from the contact surface, wherein:

the stationary contact has a groove that divides the contact surface into a plurality of areas, and a direction of rolling of the movable component intersects with a direction in which the groove extends, the direction of rolling being a direction in which a metal sheet, from which the movable component is formed, is rolled at a time of a manufacturing process of the metal sheet.

15. The push switch according to claim 14, wherein the groove includes a first groove and a second groove that extend in different directions in a plane that is along the contact surface, the first groove extend in a first direction, the second extend in a second direction, the direction of rolling of the movable component intersects with both of the first direction and the second direction.

16. The push switch according to claim 15, wherein the first groove intersects with the second groove.

17. The push switch according to claim 15, wherein the first direction is orthogonal to the second direction.

18. The push switch according to claim 16, wherein the first groove is orthogonal to the second groove.

* * * * *